US007460020B2

(12) United States Patent
Reyes et al.

(10) Patent No.: US 7,460,020 B2
(45) **Date of Patent: *Dec. 2, 2008**

(54) COMPUTER-ENABLED, NETWORKED, FACILITY EMERGENCY NOTIFICATION, MANAGEMENT AND ALARM SYSTEM

(75) Inventors: Tommy D. Reyes, Port Angeles, WA (US); Garry O. Thompson, Port Angeles, WA (US)

(73) Assignee: Incident Alert Systems, LLC, Port Angeles, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/862,929

(22) Filed: Sep. 27, 2007

(65) Prior Publication Data

US 2008/0048851 A1 Feb. 28, 2008

Related U.S. Application Data

(63) Continuation-in-part of application No. 11/228,817, filed on Sep. 16, 2005, now Pat. No. 7,277,018.

(60) Provisional application No. 60/656,198, filed on Feb. 24, 2005, provisional application No. 60/610,810, filed on Sep. 17, 2004.

(51) Int. Cl.
*G08B 23/00* (2006.01)

(52) U.S. Cl. ..... 340/573.1; 340/506; 340/521; 340/531; 340/541; 340/572.1

(58) Field of Classification Search ..... 340/506–531, 340/539.1, 539.18, 573.1, 574, 541; 455/404.1; 379/38; 709/223–224

See application file for complete search history.

(56) References Cited

U.S. PATENT DOCUMENTS 4,375,637 A 3/1983 Desjardins
4,962,473 A 10/1990 Crain
5,257,007 A 10/1993 Steil et al.
5,444,433 A 8/1995 Gropper
5,598,566 A * 1/1997 Pascucci et al. ..... 713/324
5,717,378 A 2/1998 Malvaso
5,861,804 A 1/1999 Fansa et al.
5,940,474 A 8/1999 Ruus
6,002,748 A * 12/1999 Leichner ..... 379/48
6,028,514 A * 2/2000 Lemelson et al. ..... 340/539.13
6,060,994 A 5/2000 Chen (Continued)

*Primary Examiner*—George A Bugg
*Assistant Examiner*—Son M Tang
(74) *Attorney, Agent, or Firm*—Jacques M. Dulin, Esq.; Innovation Law Group, Ltd.

(57) ABSTRACT

Secure, verifiable, computer-enabled, LAN/WAN/Wireless networked, facility emergency notification, rapid alert management, and occupant alarm systems for public, private, and government buildings, and outdoor areas for which there is a need for rapid alerts to occupants or attendees of the occurrence of impending or in-progress dangerous or threatening events. The inventive system is a highly flexible rapid alert initiation, management and archival system comprising computer-enabled and network-linked apparatus, software, and methods enabling rapid dissemination from a central station or decentralized location of alerts of the occurrence of threatening or dangerous events in a series of hierarchical, increasing levels of directed action to be taken by the occupants, and permits monitoring and controlling activity of occupants during the event, archiving event data, including audio or/and video recordings until the situation returns to normal and an all clear signal is given. Databases provide site plans to assist in the response planning and execution.

20 Claims, 16 Drawing Sheets

U.S. PATENT DOCUMENTS 6,281,790 B1 8/2001 Kimmel et al.
6,353,385 B1 * 3/2002 Molini et al. ..... 340/506
6,496,110 B2 12/2002 Peterson et al.
6,643,516 B1 11/2003 Stewart
6,690,274 B1 2/2004 Bristol
6,690,411 B2 2/2004 Naidoo et al.
6,748,343 B2 6/2004 Alexander et al.
6,809,642 B1 10/2004 Brenner
6,816,087 B2 11/2004 Lane
6,829,478 B1 12/2004 Layton et al.
6,847,293 B2 * 1/2005 Menard et al. ..... 340/539.1
7,026,925 B2 4/2006 Roche et al.
7,181,192 B2 * 2/2007 Panasik et al. ..... 455/404.1
7,233,781 B2 6/2007 Hunter et al.
7,277,018 B2 * 10/2007 Reyes et al. ..... 340/573.1
2002/0154170 A1 10/2002 Dawson
2002/0177428 A1 * 11/2002 Menard et al. ..... 455/404
2003/0062997 A1 4/2003 Naidoo et al.
2003/0071724 A1 4/2003 D'Amico
2003/0137415 A1 7/2003 Thomson
2004/0003073 A1 1/2004 Krzyzanowski et al.
2004/0004543 A1 1/2004 Faulkner et al.
2004/0203568 A1 10/2004 Kirtland
2004/0205824 A1 10/2004 Tsai
2005/0055472 A1 3/2005 Krzyzanowski et al.
2005/0091368 A1 * 4/2005 Ozburn ..... 709/224
2005/0143048 A1 * 6/2005 Binning ..... 455/404.2
2005/0151640 A1 7/2005 Hastings
2006/0001539 A1 * 1/2006 Adamczyk et al. ..... 340/539.18
2006/0049936 A1 3/2006 Collins

* cited by examiner

Boys Locker Room
Main Gym
Gymnastics
Girls Locker Room
Activities Gym
700 Building
900 Building
900 BUILDING
1200 PORTABLES
Kitchen
Cafeteria
300 BUILDING
100 Building
(ADMIN & CLASS)
Library
400 Building
Student Center
Band
200 BUILDING
Foyer
Auditorium
Stage
500 Building
Auto Body Shop
Machine Shop
Auto Shop
800 Building
600 Building IDF3
13
14
12
16 Port SW
11 (Lab)
11-1
10
9
15
17
16
RR
RR
7
8
6
5
18
19
MDF
LIB-2
LIB-4
LIB-3
8 Port SW
21
20
LIB-1
LIB-5
LIB-6
16 Port SW
LIB-7
LIB-9
LIB-8
3
4
2
1
22
23
25
24
27-1
26-1
2-2
2-1
Office
IDF1
Penthouse
Fiber Dist Box
31
30
Media Converter
To MDF
WAN
Gym
IDF 2
Mechanical
Gym 3
Boys Locker
Gym 2
Gym 1
(to IDF-1)
Girls Locker
Gym 4
Kitchen
N
W
E
S
Wire Drop
Switch
Wall Box
Fiber Run

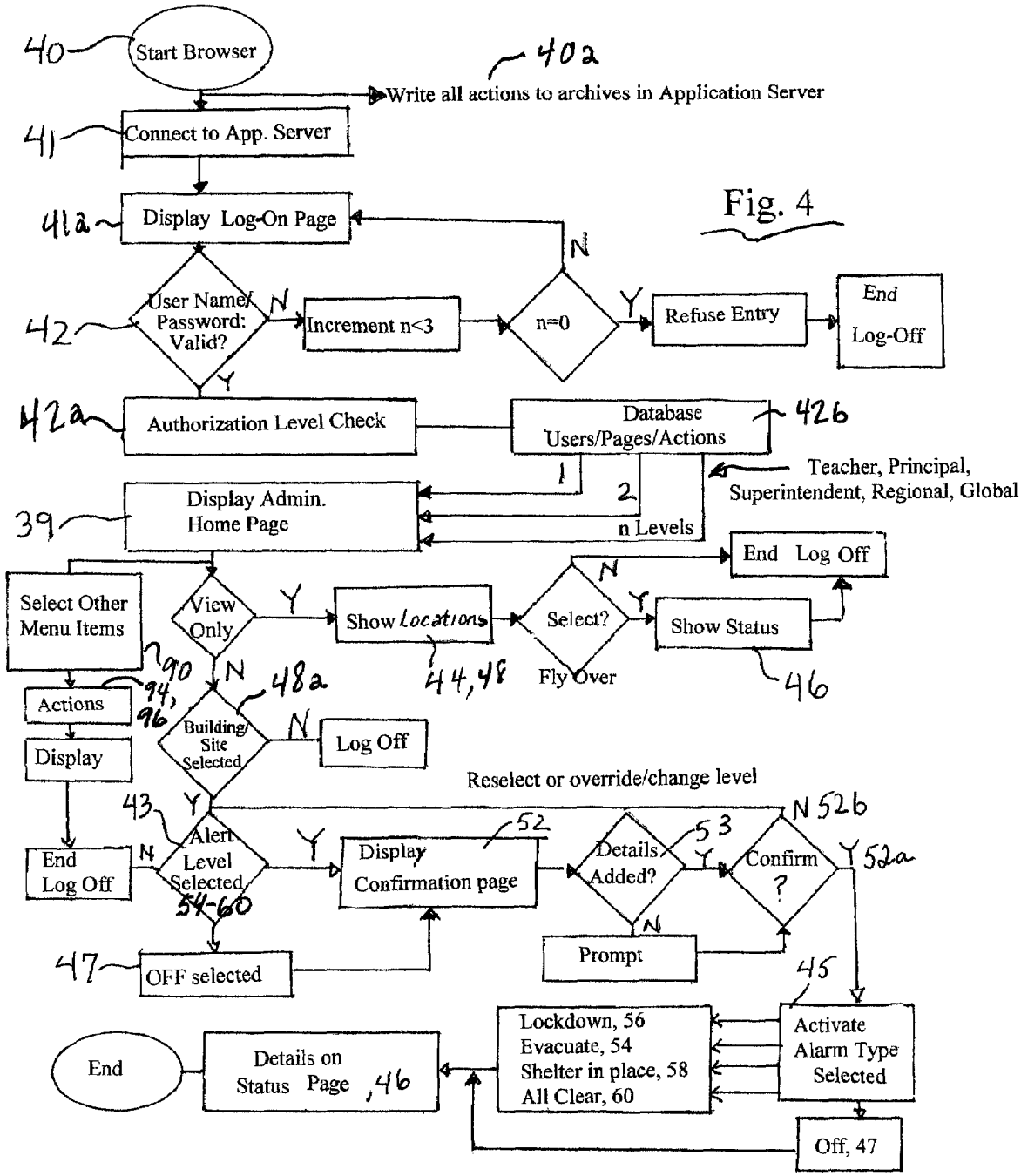
40
Start Browser
402
Write all actions to archives in Application Server
41
Connect to App. Server
41a
Display Log-On Page
Fig. 4
42
User Name/ Password: Valid?
N
Increment n<3
n=0
N
Y
Refuse Entry
End Log-Off
Y
42a
Authorization Level Check
Database Users/Pages/Actions
42b
Teacher, Principal, Superintendent, Regional, Global
1
2
n Levels
39
Display Admin. Home Page
End Log Off
Select Other Menu Items
View Only
Y
Show Locations
Select?
N
Y
Show Status
44,48
Fly Over
46
90
94, 96
Actions
N
48a
Building/ Site Selected
N
Log Off
Display
Reselect or override/change level
43
Y
N 52b
Alert Level Selected
54-60
Y
Display Confirmation page
52
Details Added?
53
Y
Confirm ?
Y 52a
End Log Off
N
N
Prompt
47
OFF selected
45
Lockdown, 56
Evacuate, 54
Shelter in place, 58
All Clear, 60
Activate Alarm Type Selected
End
Details on Status Page, 46
Off, 47

COMPUTER-ENABLED, NETWORKED, FACILITY EMERGENCY NOTIFICATION, MANAGEMENT AND ALARM SYSTEM

CROSS REFERENCE TO RELATED APPLICATIONS

This application is a Continuation-In-Part of U.S. Ser. No. 11/228,817 having the same title and filed by the same inventors on Sep. 16, 2005, now U.S. Pat. No. 7,277,018 issued Oct. 2, 2007, which in turn is the Regular application of U.S. Provisional Application Ser. No. 60/610,810 filed by the same inventors on Sep. 17, 2004 under the title: Fast Alert System, A Computer Enabled, Networked Facility Emergency Notification Management and Alarm System, and of U.S. Provisional Application Ser. No. 60/656,198, filed by the same inventors on Feb. 24, 2005 under the title: Fast Alert System II—A Computer Enabled, Networked Facility Emergency Notification, Management and Alarm System, the disclosures of which are hereby incorporated by reference and the benefit of the filing dates thereof are claimed under 35 USC §§119, 120, ff.

FIELD

This invention relates to secure, redundant, verifiable, computer-enabled, networked, facility emergency notification, rapid alert management and alarm systems installed in public, private, and government buildings, and outdoor areas for which there is a need for rapid alerts to occupants or attendees of the occurrence of impending or in-progress dangerous or threatening events. More particularly, the invention relates to highly secure, flexible, hierarchical, local, regional, national or international fast alert systems comprising computer-enabled and network linked apparatus, software, and methods enabling rapid dissemination from a central station or decentralized location of alerts of the occurrence of threatening or dangerous events in a series of hierarchical, increasing levels of directed action to be taken by the occupants. In addition, the inventive system can cause initiation of appropriate responsive actions by occupants based on type and level of alert, monitoring and controlling activity of occupants and event responders (e.g., security, fire and medical personnel) during the course of the event or danger, while archiving times and natures of events, responses and other data, including audio or/and video recordings, about the various occurrences, events, alarms, and responses, until the situation returns to normal and an all clear signal is given. Links to, or self-contained, data-bases can be accessed to provide building and site plans to assist in the response planning and execution.

BACKGROUND

At present, there are millions of home and office "security systems" installed. There are thousands of security companies that install and monitor security systems. Many patents are directed to various aspects and functionalities of such systems. Typically, these systems comprise a set of sensors connected to a telephone dialer and are designed for passive monitoring with a telephone response to a police or fire responder. Most, if not all, of these are directed to home protection or building protection at times when the building or home is not occupied. These employ a variety of incursion sensors and alarm devices and are primarily intended for protection of unoccupied property, not for protection of occupants. There is a large industry of providers of security and alarm devices and security system monitoring services. A search of "alert or alarm and systems" on MSN produced 120283 hits. There are some 3594 companies listed at http://dmoz.org/Business/Business_Services in the security/alarm services business.

Some systems involve a call-back function, in which the central station calls the home when it receives an alarm to verify if the alarm was inadvertent. This is the "are you OK" query-type system to assist in protection of occupants. If the answer is inappropriate, e.g., not according to a pre-arranged code, is strange or otherwise suspicious, or the occupant answers that help is needed, then the central station staff sends the appropriate help responder: fire, police, or medical service. Still other systems permit visual or/and audio monitoring of a remote site via telephone line, Internet connection or other links.

Currently, many public facilities such as schools, courthouses, other government buildings, sports facilities and hotels have generic alarm systems, such as fire alarm bells or horns that ring throughout the entire facility and are intended direct all occupants to evacuate the building. There are many examples of communications failures incident to emergency situations in facilities with this type of alarm installation. Typically, the alarms give no assistance to responding personnel and do not permit clarifying or change in status of event-in-progress information being provided to the occupants to supplement the initial raw alarm information. The usual response to such alarms is to evacuate the building through pre-assigned exit routes, assemble at pre-assigned points, and await instruction. There is little, if any, flexibility in the alarm and response system; communication is tenuous, slow, and difficult to control and subject to failure.

Modern schools and government facilities, for example, are typically built with distributed architecture, having many outlying buildings in a campus-type setting. Installation of a centrally controlled alarm bells or horns does not enable alerting only selected sub-areas of the sites to dangerous or hazardous events or situations without alarming and evacuating the entire complex. This leaves the evacuated population to learn by rumor the nature of the event (which is usually incomplete or wrong), provides no assistance in monitoring the progress of events or directing rescue action to rapid response personnel (e.g., police, fire, medical, SWAT, or hostage teams).

Accordingly, there is an unmet need in the art for a rapid alert system that: is easily configurable to a wide range of different types of publicly-accessed facilities: is adaptable to facilities of very wide range of very different architectures: permits feed-into and feed-back between remote sites and an administrative center; permits triggering of alerts from remote locations and from the sites themselves where hazardous or dangerous events occur; can trigger different types and levels of alerts (e.g., lockdown, shelter in place, evacuate, or all clear) for different types of events; permits "silent" alarms; enables remote audio monitoring (listen-in capacity) and remote viewing (in the physical sense, not the psychic sense) of the event in progress; permits obtaining from, or providing clarifying information to, authorities and responders; permits change in alarm nature or status as the event unfolds, including an event-end "all clear"; and permits local and on-site access to the system by arriving response professionals, including access to database(s) of prior collected and archival information, such as maps of the facility architecture, site layout, response tactical plans, facility operational systems access, controls and data base(s).

THE INVENTION

SUMMARY, INCLUDING OBJECTS AND ADVANTAGES

The inventive system comprises a secure, redundant, verifiable, computer-enabled, direct or networked, facility emergency notification, rapid alert management and alarm systems installed in public, private, and government buildings, and outdoor areas for which there is a need for rapid alerts to occupants or attendees of the occurrence of impending or in-progress dangerous or threatening events. More particularly, the invention relates to highly secure, access-controllable, flexible, hierarchical, local, regional, national or international fast alert systems comprising computer-enabled and direct or network linked apparatus, software, and methods enabling rapid dissemination from a central station, or decentralized or mobile location, of alerts of the occurrence of threatening or dangerous events in a series of hierarchical, increasing levels of directed action to be taken by the occupants. In addition, the inventive system can cause initiation of appropriate responsive actions by occupants based on type and level of alert, monitoring and controlling activity of occupants and event responders (e.g., security, fire and medical personnel) during the course of the event or danger, while archiving times and natures of events, responses and other data, including audio or/and video recordings, about the various occurrences, events, alarms, and responses, until the situation returns to normal and an all clear signal is given. Links to, or self-contained, databases can be accessed to provide building and site plans to assist initiating and propagating alerts, change in alert status, and in the response planning and execution. The system has redundancy capability built-in to prevent loss of control functionality in the event of component failure.

By verifiable is meant administrative control of pre-selected multiple levels of authorized access to the alarm status viewing and triggering control system, namely access to the pages displayed by the control system, be it direct or via a browser-type application, and recording, archiving, display and reporting all accesses to the system on a user-configurable basis. By "direct" is meant the inventive application software is loaded onto a computer, be it a server or work station which acts as a server, and which is accessed by a user via a resident user interface to initiate the alarm menu actions. This direct connectivity permits single computer management of the inventive fast alert alarm functionality to a selected space, area or location (alerting domain), rather than across the network. That is, direct means a single point of access linked directly to the alarmed location. The inventive system can thus be either network-enabled or direct linked.

The inventive occupant rapid alerting system for private and public facilities comprises a network of sensing and signaling apparatus, related application software, which may be embedded or stand-alone, and includes user interface(s), data bases and methods of using and controlling the apparatus: 1) to selectively and rapidly trigger alert signals or/and informational messages (which may be pre-recorded) to occupants in one or more chosen building(s) or sub-area(s) of a single facility, or in an entire campus, site or complex; 2) to monitor, manage and record alert or/and response actions; and 3) to archive data, such as system access and actions, and audio and visual image data, from on or before the time of first event through alert notification and event progress to resolution.

Embodiments of the inventive rapid alerting system are both site and event specific, e.g., the inventive system is flexible enough to be specific to the designed alerting domain (whether a single room/area, a single building, a group of rooms/area(s) or buildings such as a campus, in an outdoor area, or a combination of these), to pre-defined types of dangers and events, and to combinations of them. Thus, the system can be configured to be tailored to the particular complex of building(s) and their surroundings to provide the necessary capability to rapidly alert occupants therein, including providing occupants with suitable information so that they can respond efficiently and effectively to anticipated dangers, hazardous occurrences and rapidly evolving events. Embodiments of the inventive system range from a simple, single computer directly linked to the alerting domain of interest, to a small network in a single building, or to a complex, hierarchical network in a multiple-building campus over a large geographic area.

The invention in its basic embodiment is a computer-enabled hardware system that is software responsive and controlled, and a method of its use. The system, while specific to the particular facility where installed, comprises apparatus, such as: a computer network including: at least one server; client computer stations having display screens with bi-directional access to the server; provision for external access to the network by pigtail plug in, and/or by wireless, telephone, Internet, Intranet or other Net connectivity; network controlled switches and electrical power supplies; alarm and annunciator devices; video cameras and audio pick-ups; and other apparatus as may be needed in relation to communication, monitoring, archiving, retrieval, display and print reports of anticipated dangerous or hazardous events or occurrences, the events in progress, and alarm and response systems therefor. The inventive system site network is given in the examples as hard-wired, but it may be wireless or partially wireless, may be a dedicated or shared network, and typically includes IP-based VOIP telephone system, IP PBX switching systems, and IP speakers, microphones and video.

As used herein the term "site" includes both a specific location within a building or area, such as a single room or defined area, and a more general area of alarm interest, as the context will make evident, such as a group of related buildings or campus. In the former sense, the term means a specific locus, position or location in an architectural view, and in the latter sense, the term means a group of related buildings and/or surrounding areas in a facilities and grounds sense. By "remote" is meant some distance from the control computer, and includes related buildings in a single campus that are some distance from the administration office or building as well as a more distant setting, such as a regionally or nationally located central office located from tens to thousands of miles from a specific facility, site or classroom being served by the system. The term "notification" means information of an emergency, or other event of concern, received at any triggering point in the system, be it at the central office computer either from outside sources, or from a relatively remote locus within the alarmed area such that action or investigation is needed, or in the classroom or at an external site (police department). The term "alert" means initiating action from a system computer to activate one or more devices to warn people to take appropriate action, such as: evacuation; take shelter in place; lockdown; or other protective action; and all clear, situation-normal signals.

The software included in the system supports both direct operation and basic user interface and network operations and controls the various auxiliary equipment, alarms, cameras, microphones, GUI display drivers, and the like. The network controller, including the applications software for controlling the operations of the network server and client stations, controls the operation of the inventive alert system by an authorized user, and includes database capability for storage and access to maps, photographs and data pertaining to the facility and its site, or links to such databases as may be provided by third-party suppliers.

The inventive system in its presently preferred embodiment is an application specific rapid alert system, described herein by way of example with reference to a school having an administrative central core (office or building), at which a control computer or server is located, with a network-linked plurality of remote out-buildings or locations in the same building, having classrooms, gymnasium, sports complex, field or stadium, lunch rooms, libraries, tech or trade shops, and the like, in which multi-capable alert-responsive alarms are installed. In one embodiment, a computer terminal at, in or near each system alert-alarmed facilities site has installed application software to enable a designated, authorized person, such as a teacher or administrator, to report an event of concern originating in that site (e.g., on school grounds) or one of its remote sub-locations (e.g., in a classroom, cafeteria, etc.), or/and to activate alerts, either directly or via the network.

Thus, in the inventive system, whether the information requiring an alert is received at the administrative office, or acquired externally from any source (e.g., police department), or is acquired remotely in the campus (e.g., in a classroom), it can be acted-on to trigger an appropriate type, level and location of the alert. For example, if there is a disturbance, an incursion, or other event of concern that occurs, or that is perceived to be imminent, not in the central administrative core, but rather in a remote location of the facility, the authorized person (authorized teacher, librarian, coach, maintenance person, hall guard, etc.) in that location can activate an alert alarm and additionally, or alternatively, can report via computer network or by telephone, the event and its nature to the administrative office or externally to responders, so that selective and appropriate monitoring and response management action can be initiated from the central core, or conveyed to appropriate responders for response management and action, such as police, national guard, Homeland Security, fire, medical personnel, or Haz-Mat, and the like, professionals.

The system central control is also capable of receiving reports about actual, in progress or imminent events of concern via any modality (e.g., Internet, radio, TV, telephone, oral anecdotal, e-mail, and the like) from both outside and inside sources, and capable of making reports to, or requesting assistance from, authorities outside the alarmed site area. Informational messages can be passed among computers within the alarmed site network.

In addition, the inventive system includes, in one or more options, a wide range of sensor systems that are strategically placed throughout the site, complex or facility, including: network IP cameras; fire or smoke detectors; sonic detectors that can be selected for ot tuned to unique event signatures, such as the unique signature of gunshot(s), glass breakage, screams, flames, explosions, and the like; rapid pressure fluctuation sensors; chemical sensors, such as hazardous materials release, e.g., gases, gasoline or other volatile flammables, and biological pathogens; IR detectors; US (ultrasound) detectors; thermal detectors (temperature); localized pressure or weight sensors (e.g. pressure mats, weight sensing transducers, etc.); water detectors; wind speed; and the like.

System alarm elements are selected from one or more of: recorded messages (which can be selected by the alerting authorized user from a menu of pre-recorded alert or other instructional or directive messages), audio alarms, such as bells, horns, sirens, buzzers, beepers and the like; visual alarms such as flashing lights, change in illumination, special signage being illuminated, computer screen pop-up alarms; silent alarms, such as flashing icon on a computer screen of an authorized person to be alerted (e.g., a teacher in a remote classroom) accompanied by a pop-up notice that requires, invites or requests a confirmatory response and the freezing of any application that is then open in the computer; initialization of visual monitoring, e.g., cameras in the classrooms or halls, or external cameras around the facility; non-localized "outside" alerts, e.g., to fire, police and other law enforcement agencies, Haz-Mat, medical, or other emergency responders; or to more regional governmental or administrative offices on a need to know basis, and the like.

The system software for control and operation includes the following functionalities:

It is configurable on the basis of physical location of the selected number of areas to be alerted, number of sensors, nature and types of alarms (audio, visual, silent such as vibrator or screen pop-up type), types of incidents, coding of the alerts, and the like;

It is configurable on the basis of selective authorization of access to the system, including log-in and alert activation password and confirmation of action protection, anti-hacking firewalls, verification and archival tracking of access and alert attempts, and several levels of access rights, including full access, limited purpose access and view-only current status access, and the like, and to selectively add new alert levels or types tailored to a specific site;

It enables access to and reports on: real time event-in-progress information; map-type schematics, architectural details and site views of the facility showing the area(s) to which alerts have been sent or within which events are occurring; post-event logs of the event, time of alerts, response, etc; weekly, monthly or yearly historic reports of the system access, activity, operation and the like; and a wide range of menu selectable management reports;

It enables alert activation from any connectivity device functioning as a client computer linked to said network by an authorized user from a plurality of sites or loci within or exterior of a site or facility complex. The connectivity device may be any present or future of access device(s) (e.g., computers, PDA, cell phones, and the like) that are linkable to the network, or provide user interfaces for direct linking to alarm domains of interest;

It enables system redundancy, control, data base and stored map access, alarm activation, communication, and monitoring through a set of web pages and graphics using Internet Protocol;

It provides, or can provide access to, and builds or can assist in building a database of information pertinent to facility in which the system is installed, including computer accessible maps, floor plans, site photos, hazardous materials locations, utilities plans, safety zones, ingress and egress, and the like; and It enables system installation using Internet Protocol in a Local Area Network, or a Wide Area Network, and linkage to other security networks or the Internet.

Accordingly, the inventive system comprises an application-specific Internet Protocol-based, networked alert system for public or private facilities that is accessible from a plurality of sites to provide a high degree of flexibility in selection, installation and triggering of alert devices, to provide to emergency responders a source of easily accessed data and information about the alarmed facility, the nature and time of the alert, allows for immediate changes from one type or status of alert to another including an alert that notifies occupants of when the danger has passed, provides means for electronic written and/or audio communication between networked computers as to the nature of the emergency event, to establish a means of remote physical, real-time viewing of, or/and listening-in on, dangerous or hazardous events in progress, and to enable linking of local systems to regional or national security networks for real time receipt and monitoring of information on hazardous events or situations beyond the local boundary, and to alert regional or national authorities of hazardous or dangerous local events, and permit monitoring of events in real time as they unfold.

BRIEF DESCRIPTION OF THE DRAWINGS

The invention is described in more detail with reference to the drawings, in which:

FIG. 1B is a schematic of the logical network diagram of the Local Area Network applied to the campus of FIG. 1A, and FIG. 1C shows the physical network diagram linking the inventive system components in a single building school facility;

FIG. 4 is a logic flow diagram of the control of the computer-enabled inventive rapid-alert system by the activation application program installed at the system application server, from the authorized user decision to initiate an alarm to activating, changing or deactivating the selected alert alarm units;

DETAILED DESCRIPTION, INCLUDING THE BEST MODES OF CARRYING OUT THE INVENTION

The following detailed description illustrates the invention by way of example, not by way of limitation of the scope, equivalents or principles of the invention. This description will clearly enable one skilled in the art to make and use the invention, and describes several embodiments, adaptations, variations, alternatives and uses of the invention, including what is presently believed to be the best modes of carrying out the invention.

In this regard, the invention is illustrated in the several figures, and is of sufficient complexity that the many parts, interrelationships, and sub-combinations thereof simply cannot be fully illustrated in a single patent-type drawing. For clarity and conciseness, several of the drawings show in schematic, or omit, parts that are not essential in that drawing to a description of a particular feature, aspect or principle of the invention being disclosed. Thus, the best mode embodiment of one feature may be shown in one drawing, and the best mode of another feature will be called out in another drawing.

Figure 1A:
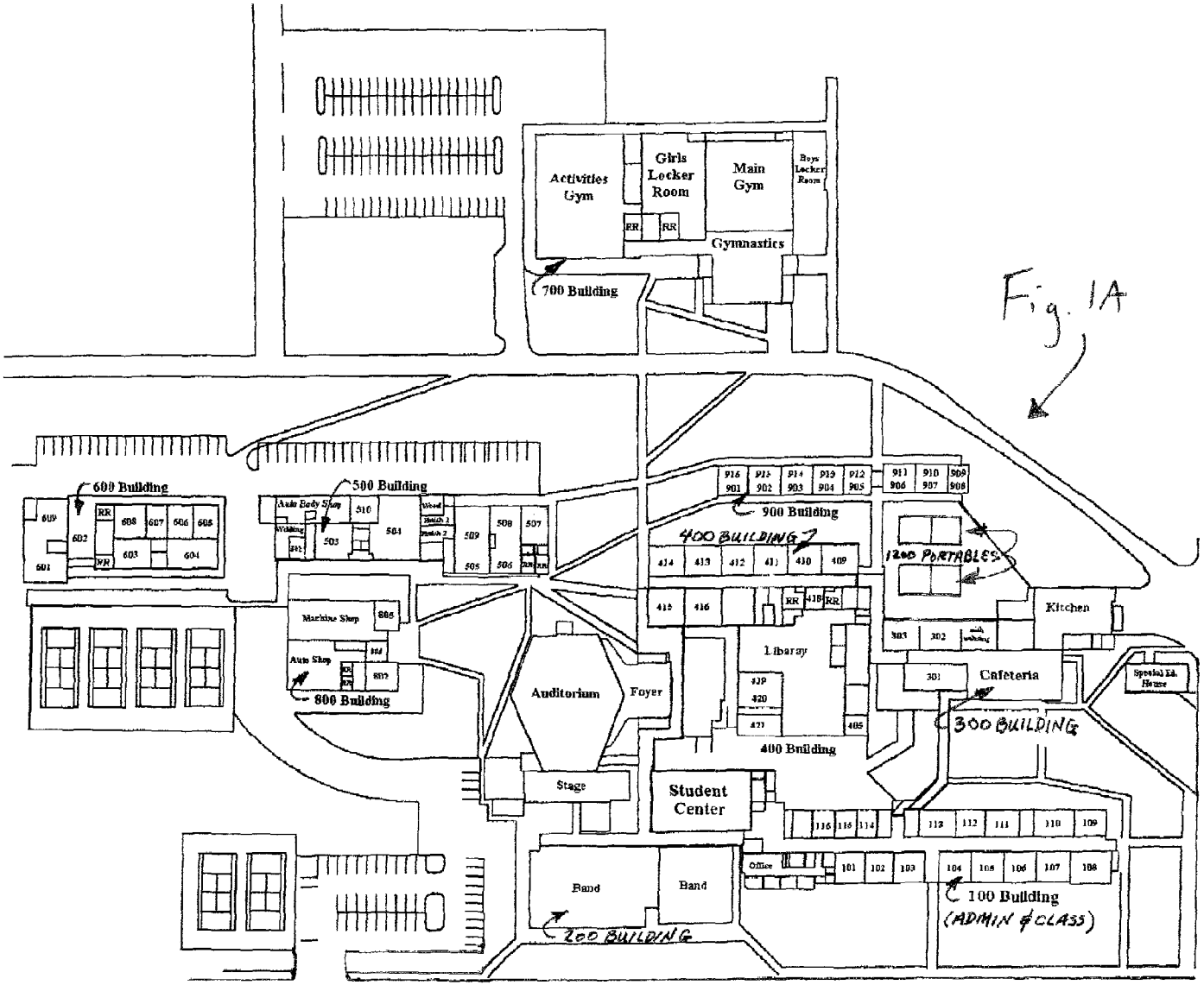
FIG. 1A-1C are exemplary "maps" of typical school facilities showing the context in which the inventive rapid alert system is applied, with FIG. 1A showing a typical high school campus of seven building clusters.
Figure 1B:
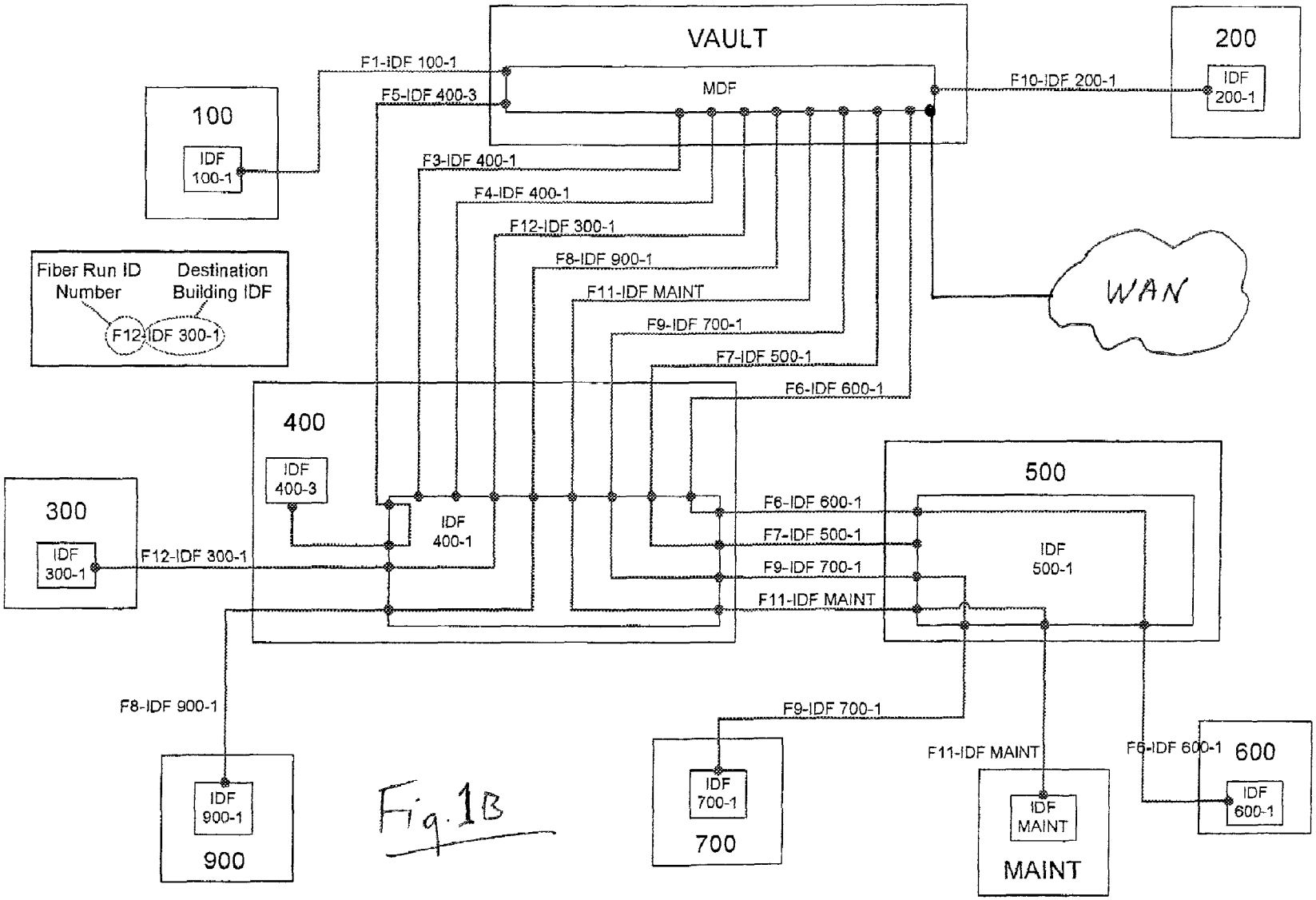
Figure 1C:
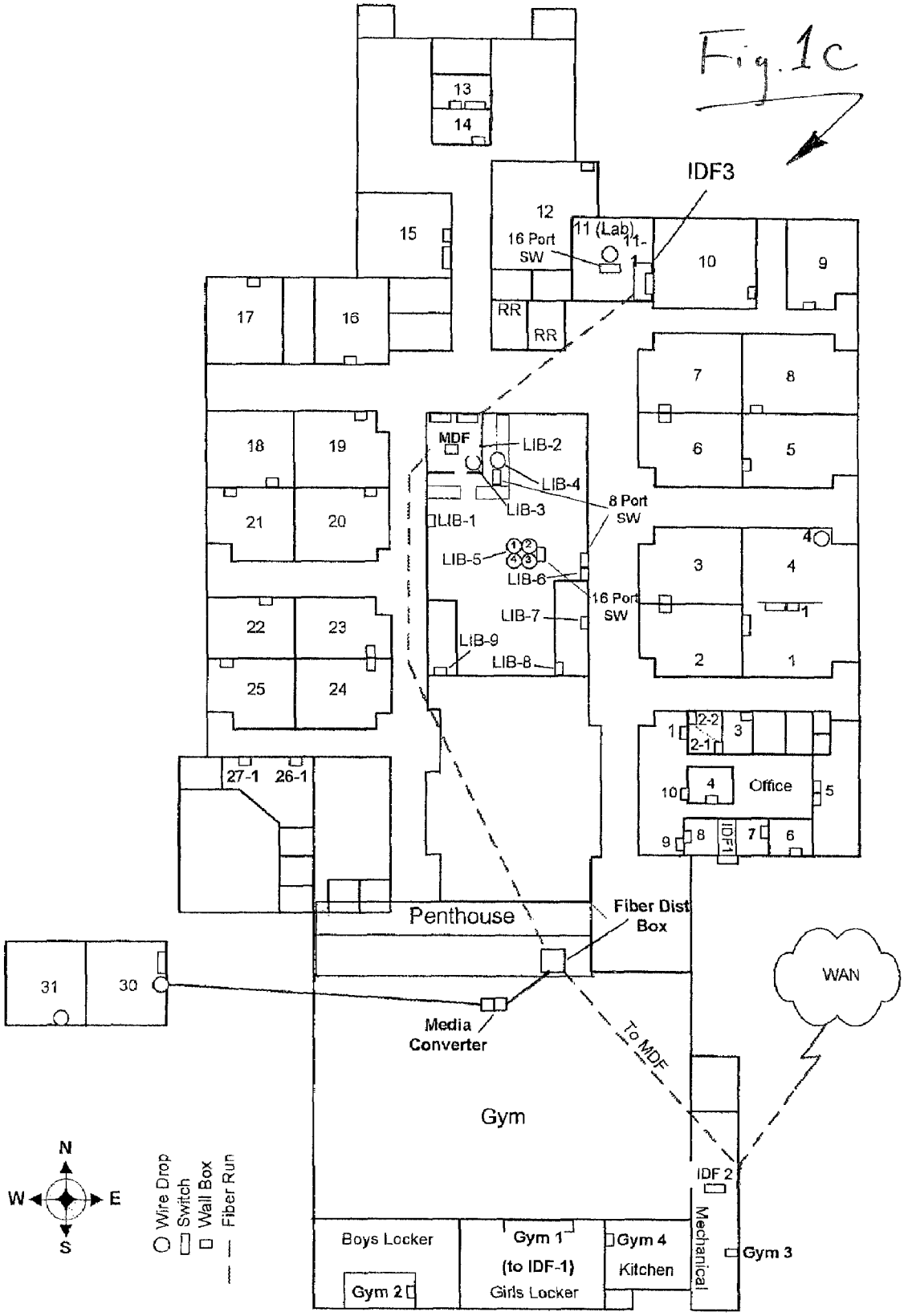

The inventive system will be described by way of example with reference to schools, such as seen in FIGS. 1A-1C, having an administrative central core (office or building), at which a control computer is located, and a plurality of remote out-buildings or locations in the same building, such as classrooms, gymnasium, lunch rooms, libraries, tech or trade shops, and the like where multi-capable alarms are sited. As best seen in FIGS. 9-12, the alert to any and all buildings on the shared network can be triggered from and received by, any/all computers, phones, cell phones, PDAs & tablet computers, and laptops, regardless of location, so long as they have authorized, verifiable access to the system and authority to sound or receive the alert alarms.

FIG. 1A-1C are exemplary "maps" of typical school facilities showing the context in which the inventive rapid alert system is applied. FIG. 1A shows a typical high school campus of seven building clusters, identified as the 100 through 700 buildings, with the 100 building being the administrative central core. This shows the context of the problem, in that a dangerous event could impact the distant athletic facilities building 700 without affecting the other buildings, and there is need to selectively alert identified building(s) by a specific type (nature) and level of alert. FIG. 1B is a schematic of the logical network diagram of the Local Area Network applied to the campus of FIG. 1A, in this case the buildings being hard wired from the Main Distribution Facility (racks of switches and media conversion electronics), here the Administrative core office in building 100, to the other buildings via Intermediate Distribution Facilities, as shown. In this example fiber optic is used to link the buildings, and the inventive alert system server containing the applications control software is located in building 100. Each drop in the classrooms or other types of rooms in the other buildings 200-700 permit hooking up the inventive system alarms, sensors, and client workstations. In addition, this campus facility can be linked to a Wide Area Network, including to the school district administrative headquarters, as shown.

FIG. 1C shows the physical network diagram to which the inventive system components are linked in a single building school facility. In this case, the school is linked to a Wide Area n Network such as a district office, as shown, and also includes an office block having offices 1-8 as shown. There is a gym, a library and 30 classrooms (numbered 1-30), including two mobile classrooms 30 and 31. The main fiber optic run is shown, and it should be understood that each of the wire drops switches and wall boxes identified are linked to the MDF or the IDFs as identified. The control computer can be located in the Office complex, such as in the office of the principal, office #5 of that block. There can be parallel control at the district office as well via the WAN. Note the Media Converter (identified as being in the gym, but actually next to the Fiber Distribution Box) that permits transfer of signal from fiber to CAT5 line to the mobile classrooms 30, 31. Each teacher has a "client" computer station linked through the wall boxes (acks) to the central computer. As described in more detail below, the alerts can show up on screen of the affected individual teachers. In addition the sonic and/or visual alarms triggered by the inventive alert system may be connected either to this digital network or wired separately.

The maps of FIGS. 1A-1C may be resident in a database linked to the inventive system or may be resident in a database that is part of the inventive system control software. These maps may be called up by responders to assist in response logistics and tactics. They are also available to service technicians for maintenance, modification or upgrade of the system.

Figure 2A:
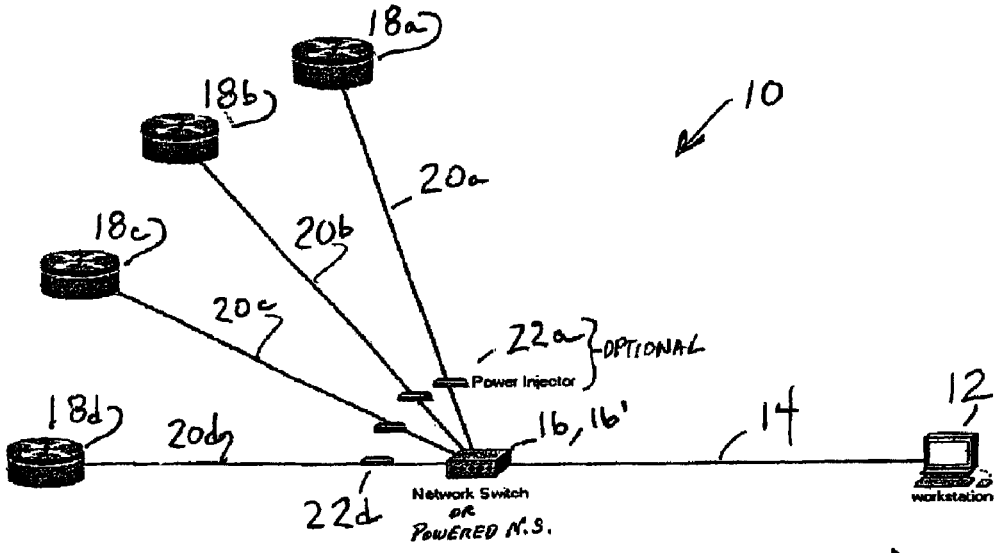
FIG. 2A is a schematic of two embodiments of the physical architecture of the inventive fast alert system within a site, a first embodiment employing a powered network switch in a parallel alarm device layout, and a second embodiment employing an optional power-injected system in a parallel layout.
Figure 2B:
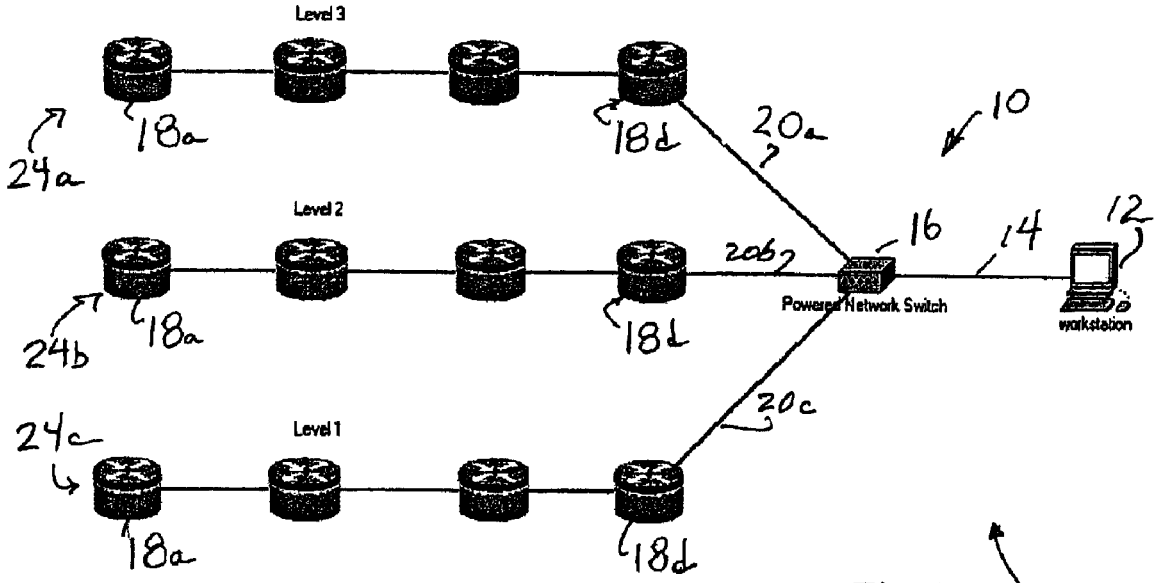
FIG. 2B is a schematic of a third embodiment of the architecture of the inventive system within a site employing powered network switching in a multiple series-in-parallel network.

FIGS. 2A and 2B show three alternative embodiments of the alert alarms in the inventive rapid alert system 10. The various embodiments differ in the methods and apparatus of switching and powering the alarms, and, also, in the alarms being installed either in parallel or in series. In a parallel installation, individual alarms can be activated, but in a series installation, all of the alarms in the series are activated together. In the design of an alarm installation at a particular facility, one or more of these embodiments can be used. One skilled in the art will readily understand that specific implementation apparatus, cabling, switching, etc. will vary from one embodiment to another due to the particular site and structural features of the facility being equipped.

In all of FIGS. 2A and 2B the alert alarms are network controlled and powered multi-tone alarms having colored flashing strobe lights for visual alert as well as audio alert. The alarms have a built-in two-port network switch connected to an embedded web server that controls the selected tones and the colored strobe lights.

FIG. 2A shows a first embodiment of alarms for the inventive system 10 in which a central control computer 12 is linked via network cable 14 to a powered network switch 16. The network controlled alarm units 18*a*, 18*b*, 18*c* and 18*d* are installed in parallel, connected to the network switch 16 using network cable. The control computer is configured with an operating system standard (such as Windows XP Pro, Linux, or MAC OS10) and alarm system application software that functions per the logic of FIG. 4 and as further described herein. It also includes graphic displays of the type shown in the screen views illustrated in FIGS. 5 through 8. In the preferred embodiment of FIG. 9, the inventive rapid alert initiation, management and archiving application program is resident in an application server (which may be a web server) linked in the network, and the computers 12 of FIGS. 2A, 2B, 3 and 10-12 are client computers from which access to the rapid alert program is launched via browser (a user interface on a computer that allows navigation of objects, including but not limited to: a direct access user interface application, applet, code or functionality; a web browser; a file browser: and the like). The inventive system is computer-enabled such that the authorized user selects an appropriate icon or check box in a graphic display created by the rapid alert application software, the selection of which triggers the application server 88 or control computer 12 (which may be a workstation, particularly in the case of a direct implementation system) to issue a signal to the network switch to activate one or a plurality of alarms (or direct to one or more alarm devices). Individual site alarms, such as audio multi-tone alarm units with visual flashing strobe-lights, 18*a* through 18*d*, are installed at pre-selected sites remote from the control computer, such as in classrooms, halls, lunch rooms, gyms and the like, via network cable, e.g., fiber or CAT 5 cable, 20*a*-20*d*. When an activate alarm signal is received at the network switch 16 from the authorized user control computer, the switch responds by furnishing power to the appropriate alarm. It should be understood that the alarm may be a speaker, and the alarm may be a pre-recorded message.

In operation, when the system control authority receives notification of an event or danger situation and makes a decision for alarm action, the appropriate icons are selected on the monitor screen of computer 12 to signal via cable 14 the powered network switch 16 to switch on power via cables 20*a*-20*d* to one or more of the selected alarm units 18*a* through 18*d*. The alarm then activates and continues in operation until further action is taken at the control computer to signal the network switch to turn off power to the alarm units.

In an important alternate, second embodiment, the powered network switch 16 can be replaced with a combination of a regular network switch 16' and individual power injectors 22*a*-22*d* associated with each alarm branch. When signaled by the computer 12 the un-powered network switch 16 triggers the computer-selected power injectors 22*a*, 22*b*, 22*c*, and 22*d* to turn on power to their associated alarm unit 18*a*, 18*b*, 18*c*, or 18*d*.

FIG. 2B shows a third embodiment of alarms in a parallel-series configuration that is similar to the configuration of FIG. 2A, except that each alarm branch 24*a* through 24*c* has a series of alarms 18*a* through 18*d* rather than a single alarm. Operation of the system permits activation of one or more of the parallel branches, but requires that all of the alarms in that particular branch, 24*a*, or 24*b*, or 24*c*, operate together.

Figure 3:
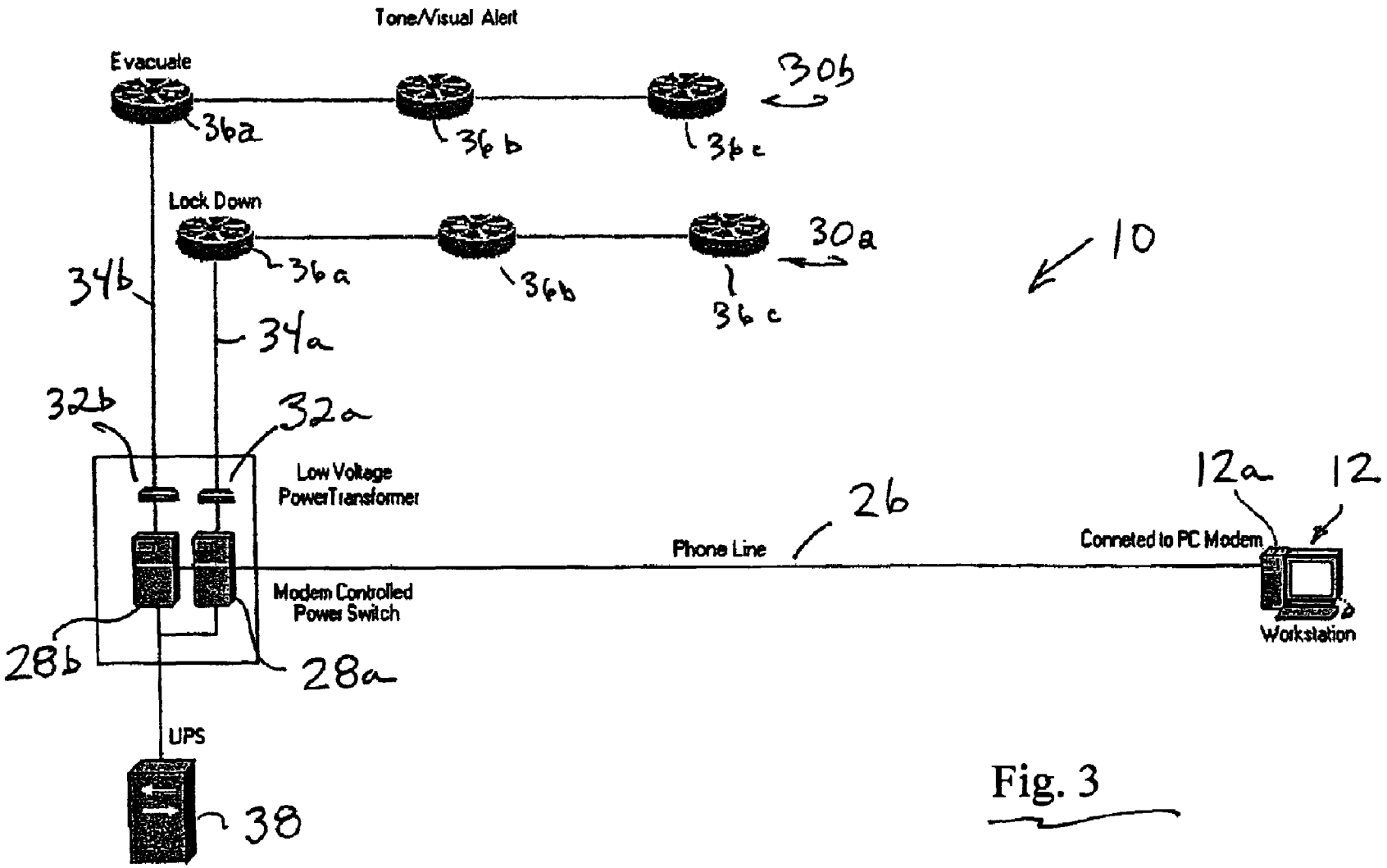
FIG. 3 is a schematic of a fourth embodiment of the inventive system within a site or remote central administration, using a universal power source connected through modem controlled switches actuated by the central computer to low voltage power transformers that in turn power alarms switch deployed in series.

FIG. 3 shows a fourth embodiment of alarms of the inventive rapid alert system using modem-controlled power switches 28*a* and 28*b* controlled by phone line connected to a PC modem 12*a* at the control computer 12. A uninterruptible power supply 38 is used to power the alarm units 36*a*, 36*b*, and 36*c* through the power switches 28*a*, 28*b*, power transformers 32*a*, 32*b* and standard electrical wiring 34*a*, 34*b*. The alarm units 36*a* through 36*c* are deployed in series 30*a*, 30*b* similar to the deployment in FIG. 2B. The computer 12 may be a client workstation or server central computer, and may be on site or remote at a local, regional or national center.

Figure 5:
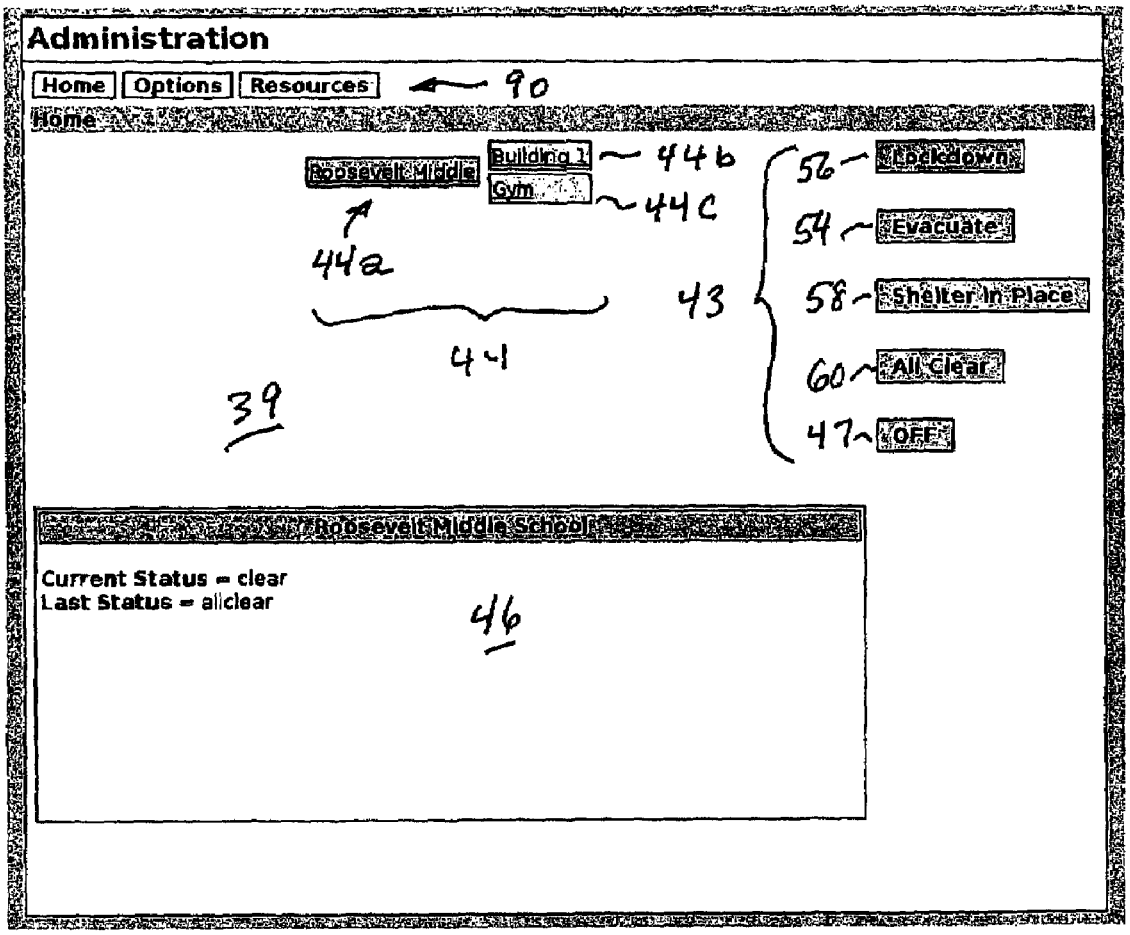
FIG. 5 is a computer screen-shot graphic display created by the application software of the instant system showing a typical view-only screen of building site(s) and type of alert alarms activated and a pop-up in the lower half showing the present status of the particular building selected.
Figure 6:
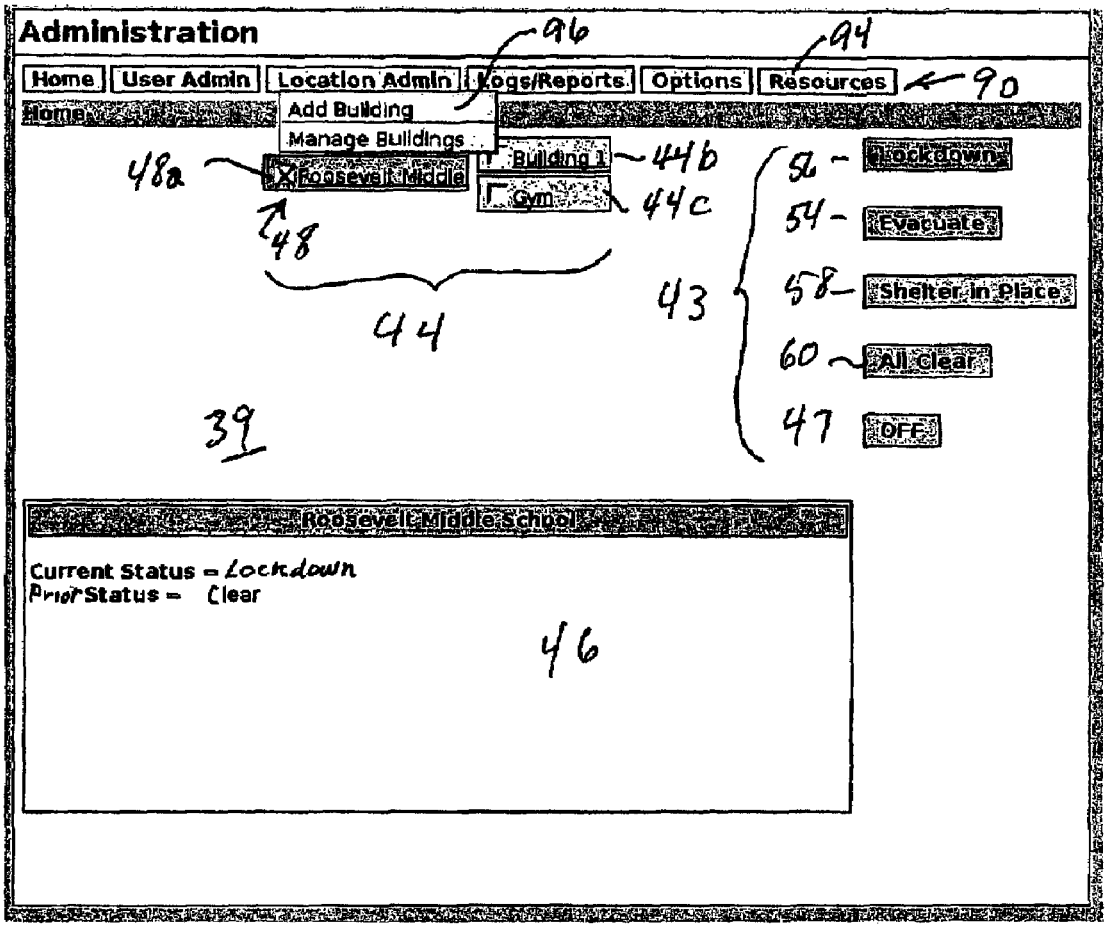
FIG. 6 is a similar computer screen-shot for a school principal level authorized user that has selected to trigger the alert for the entire middle school buildings of FIG. 5 and the alert alarm status and former status of the school.
Figure 7:
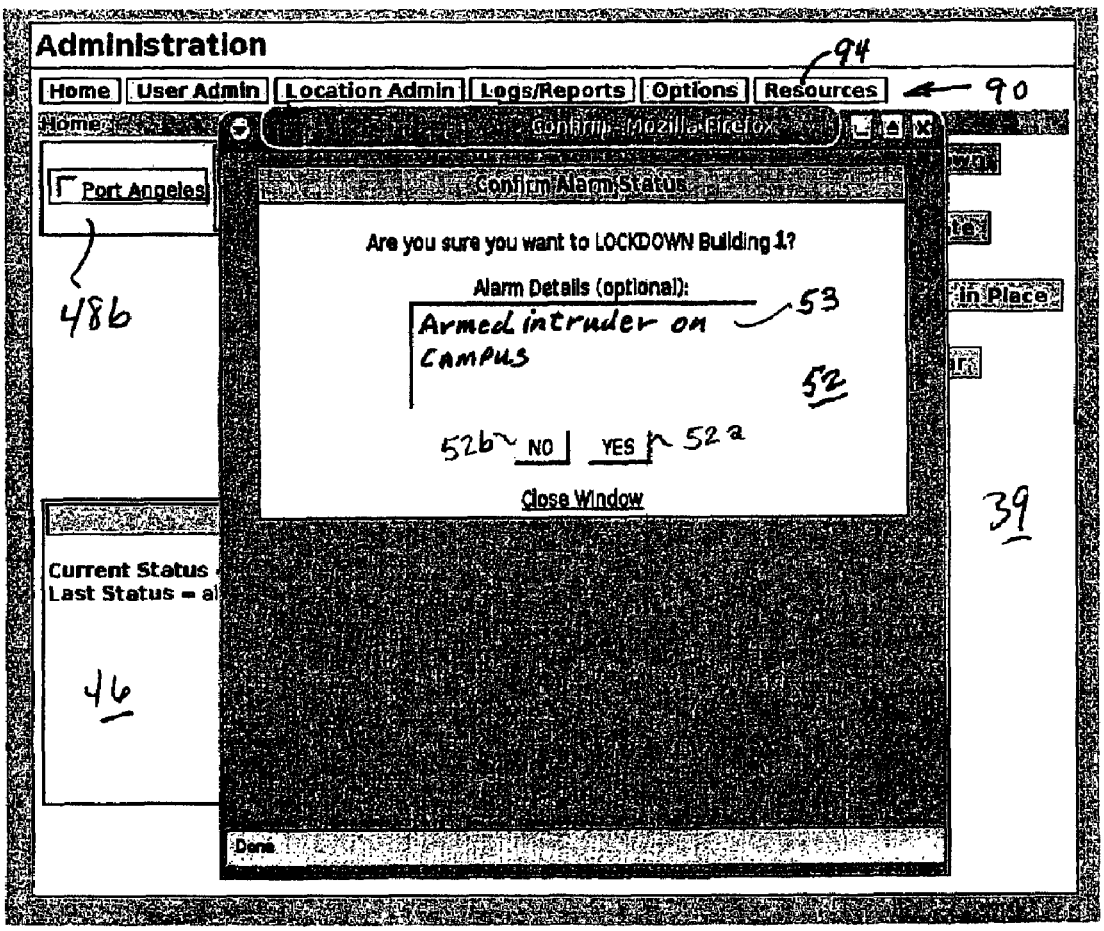
FIG. 7 is a follow-on screen to that of FIG. 6 for district level authorized user showing the pop-up confirmation of alarm to be sounded after the User clicks on both the building and alert type in FIG. 6.
Figure 8A:
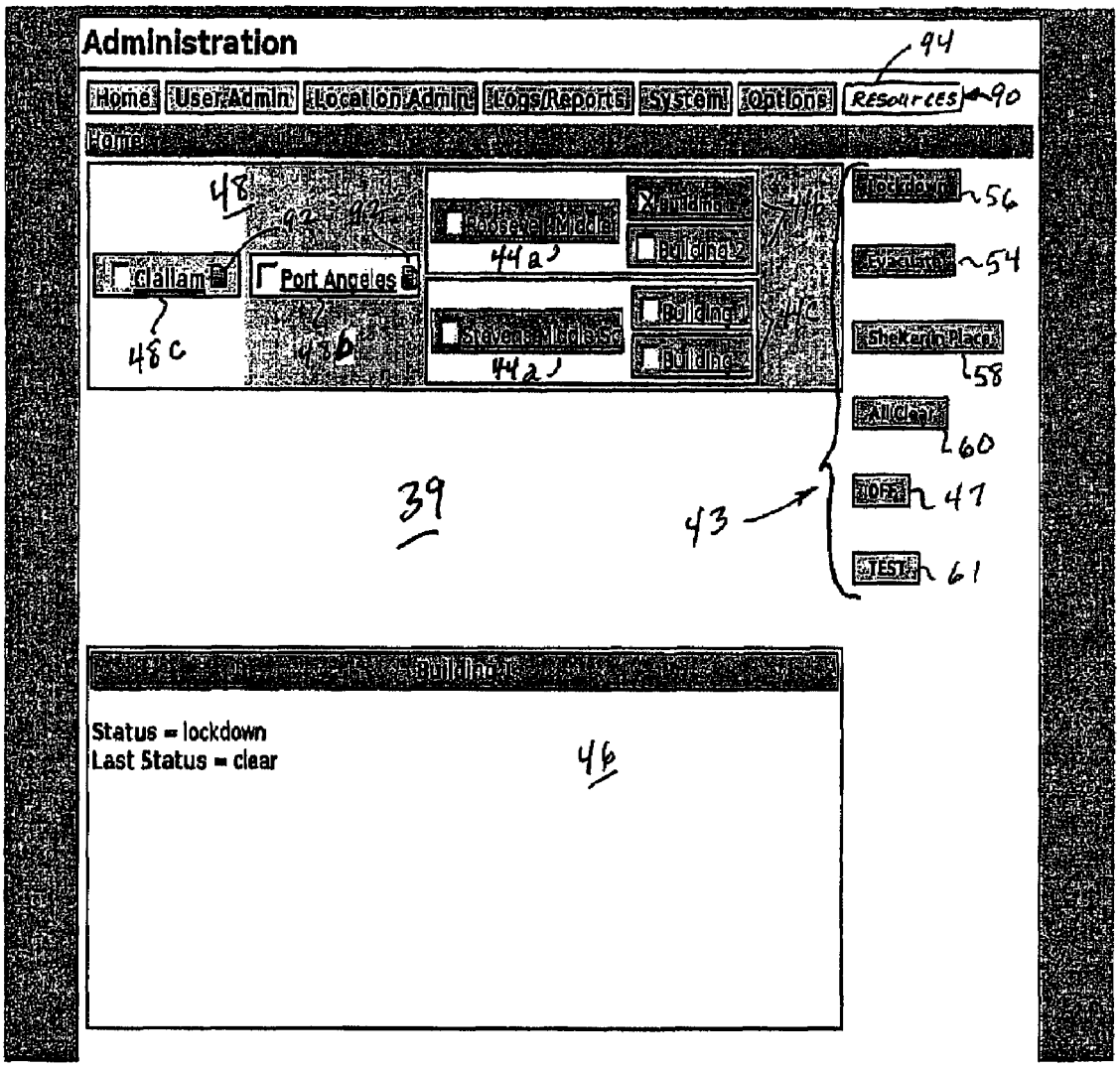
FIGS. 8A-8C are similar computer screen-shots showing in FIG. 8A a full hierarchy through the regional level of authorization, FIG. 8B showing the drop-down sub-menus for User Administration, and FIG. 8C showing drop down typical drop-down menu options for Location Administration.
Figure 8B:
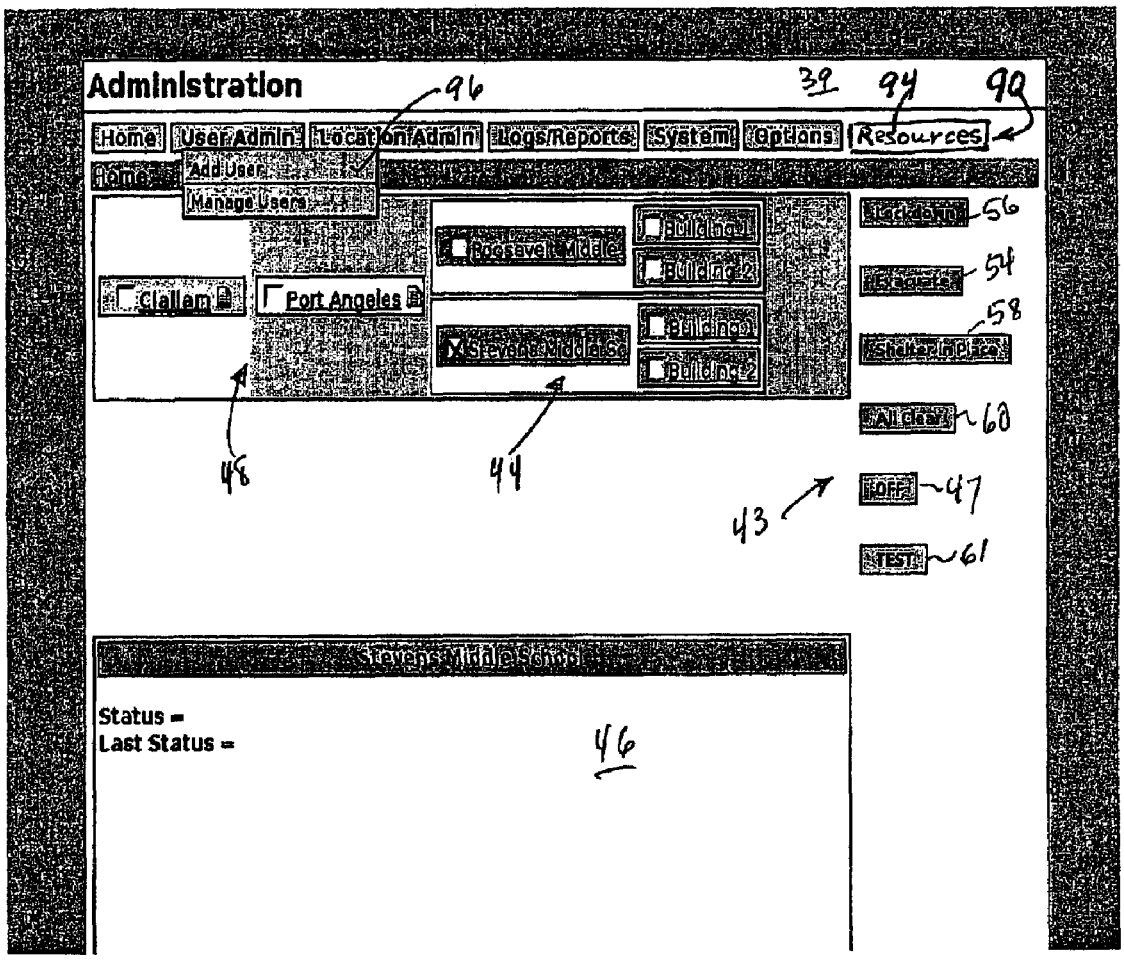
Figure 8C:
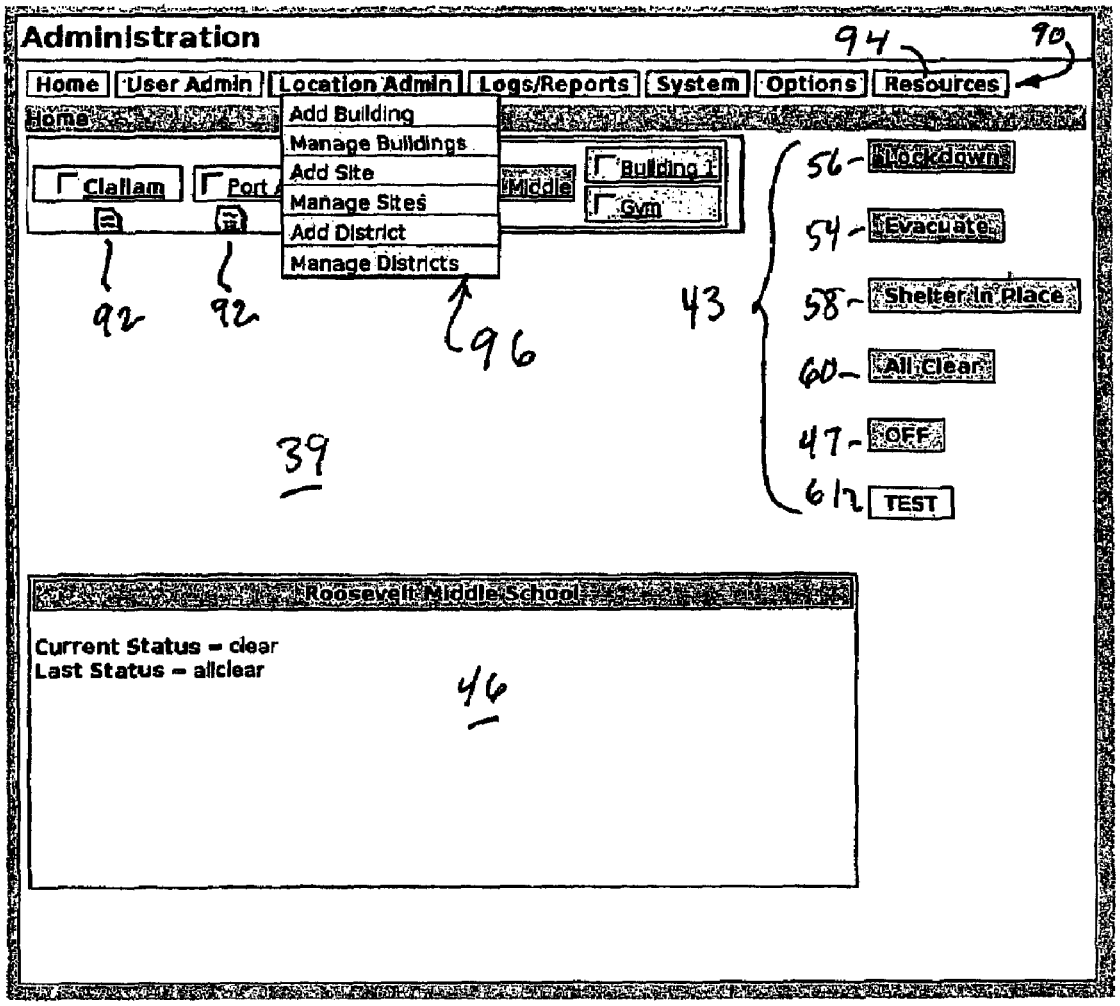

FIG. 4 through FIG. 8C are interrelated, showing exemplary functionality, logic and associated displays on computer screens of the inventive rapid alert system application control program. Accordingly, these Figures are described together, and are best considered together. FIG. 4 shows one exemplary schematic of the logic sequences and actions to turn selected alarms on and off and for authorized user management of the system. FIGS. 5-8C are selected exemplary computer screens that the authorized user sees and uses based on the level of their User rights by fly-over and click-to-select, to activate the program to cause the control computer or application server computer to operate the alert alarm system. The Teacher level, View Only (no authorization to trigger alerts or manage the system or users) is shown in FIG. 5. The Principal level view with trigger authorization level for a single school is shown in FIG. 6. A District Superintendent view with trigger and management level authorization is shown in FIG. 7. A more global, Regional/State/National Superintendent or Director level authorization with trigger and management authorization, is shown in FIGS. 8A-8C), User rights include, but are not limited to: View Only (no authority to trigger alerts, and usually limited to a specific building or site, such as teacher would be authorized for); Local/Facility View (authority to view and trigger alerts to a specific school and add text messages, such as for a principal); District View (authority to trigger alerts for entire districts and add text message, such as for a superintendent); Regional View (authority to trigger alerts for an entire networked county or region and add text message); and National or Global View (authority to trigger alerts for multiple counties, entire states or groups of states, nationwide, such as for Homeland Security, Federal entity, such as FEMA, Coast Guard, National Guard, Military).

The inventive rapid alert system is a user-friendly, preferably web-based network of computers that doesn't require users to install any special software to operate the system. Any computer with a web browser, such as Internet Explorer, that is connected to the network can access and maintain the inventive rapid alert system providing that they have the proper login credentials. Each login account is tied to a security level allowing the user to perform various tasks ranging from viewing alert status on the low end to adding/editing/deleting user's accounts and adding/edit-ing/deleting selected monitored locations (e.g., single buildings or classrooms of a campus or facility) at the high end.

Referring to FIGS. 4 and 5-8C, the typical authorized User would experience the following when using the inventive system to view or give warning at his or her respective location(s):

1. Initiating the inventive system: When an authorized user is directly or indirectly notified of a danger event being imminent, occurring or ended, and he/she makes a decision either to activate or deactivate and alert alarm, as the case warrants, the User launches a browser application, 40, configured to the alert system link by clicking on an Icon from the desktop level screen (the assumed precondition is that the computer is on and browser software is loaded on the client computer as an applications program). The User is automatically routed to the application server, 41, on which the system application software is located. A secure login page 41*a* is displayed to the User, such as:

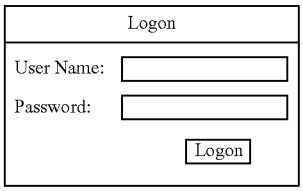

Logging into the system: Continuing with FIG. 4, after the Username and the Password are entered, they are validated, 42, by the program consulting a database of authorized users. If authorized, the User is allowed access to the system. In the background, the server is logging all successful and unsuccessful login attempts, 40*a,* to include date and time, for auditing purposes.

2. Once logged in: An "Administration" page 39 is written and displayed (FIGS. 5-8C) on which a menu 90 of active sub-pages is identified, such as: Home (the program administration or use entry page); Options (log off or change password); User Administration (wherein the system is configured to add, delete or modify users who are authorized to use the system at the various levels, change passwords, add or delete levels of security such as access authorization or permissions levels, and the like; to add or change users, the administrative User follows the templates of a Wizard app embedded in the system application program, which typically includes Next, and Back buttons); Location Administration (wherein information regarding a particular facility, site, classroom, campus, etc., is configured, entered, changed, deleted or modified); Logs/Reports (wherein various types of reports on events, system access, user access, and the like management reports and logs may be displayed and printed); System (options for configuring the station the User employs to access the rapid alert system software, such as providing client unit settings, IP addresses, and the Computer Address Redundancy Protocol ID); and Resources (providing links to the facility, building or site location map database, contacts, response tactical planning data, etc., which database may be either internal or external to the application server). Only logs related to the particular User's authorization level are permitted by the rapid alert system application software program to be printed. Different examples of such drop down sub-menus are shown in FIGS. 6, 8B and 8C. In this example, the User stays on the Home page, and is presented with a tree showing only the locations with which the login account (of the authorized user) is associated 42*b.* For instance, as displayed in FIG. 5, the Teacher is allowed to View Only his/her facility, 44, Roosevelt Middle School, 44*a,* and two exemplary buildings that are located at that school, in this case Building 1 and the Gym, 44*b* and 44*c.* When the cursor is placed over a building name (e.g., via mouse), the prior status of that building is displayed, "Current Status=clear", and the prior status "Last status=all clear" in the status box 46 below. The status of each location is also visually displayed in the tree 44 by a color code system that matches the tree 43 of alarm status buttons, 47 and 54-60, located to the right of the tree 43 as displayed in FIGS. 5, 6 and 8A-8C. FIG. 5 shows the lowest level of user authorization, that is, a "View Only Status" level of authorization, the User not being permitted to activate an alarm from the tree of alert selections 43 to the right in FIG. 5: Lockdown 56, Evacuate 54, Shelter in Place 58, All Clear 60, and Off 47.

3. Sounding an alert: Referring to FIGS. 4, 6 and 7, triggering an alert for a room, building or set of buildings involves a simple step of selecting (by clicking) the box for each room/building, 44, or entire school 48, the User has chosen to alert, then moving the cursor to the alarm type menu tree 43 to the right and clicking the button for the selected alert 54-60 to be sounded, 45. FIG. 6 shows a hierarchy of areas 44, 48 in which the alert can be sounded: the entire school (all buildings in the school, 48), or individual rooms/buildings (Building 1, 44*b*, and the Gym, 44*c*). In FIGS. 8A and 8B two additional levels of location hierarchy are shown, first the city, Port Angeles 48*b*, and an entire Region or County, Clallam 48*c*. Thus, the User can selectively and rapidly alert the entire occupant spaces in multiple buildings or facilities/sites with a one click selection (see the X in the box 48*a* of FIG. 6) of the appropriate facility name or area/region by moving up the hierarchy tree (e.g., to the left in FIG. 8A from building, to school, to school district/city, to county/region/state/global). That is far faster than multiple calls to each and every one of the schools to manually sound an alarm. In the example given in FIG. 6, all of Roosevelt Middle school, 48*a*, has been selected, and when the Lockdown button 56 to the right is selected by clicking on it, immediately the color of the name bars Roosevelt Middle school and both buildings change to the color of the Lockdown bar (red), and the Status of Alert 46 of that building pops up in the lower half of the page 39., in this instance the current status is "Lockdown", and the prior status was "Clear". FIG. 6 show the school Principal level of authorization of alert triggering, and also shows the location management options in drop down sub-menus 96.

4. Confirmation: FIG. 7 shows the District Superintendent level of authorization, the entire city, Port Angeles 48*b*, is shown to the left of the confirmation pop up 52. Once an alert button 54-60 is clicked from the alert level tree 43 in FIGS. 4 and 6, a confirmation window 52 will pop up, FIG. 7, to give the user the opportunity to cancel an unintentional click or proceed with sounding the alert. At this time the user may also enter a message 53 relating to the alert that other authorized users can read to better understand what the emergency is or obtain written instructions on how to best respond. For example, the Alarm Details text might say: "Armed intruder on campus"; "Hazardous spill in ChemLab"; "Leaking gasoline in Auto Shop"; "Tsunami Alert, landfall in 30 minutes"; etc. The text in box 53 is continually logged and can be updated during the emergency to provide current info as the event unfolds, and to recreate it later.

Each alert triggered and attempt to trigger, including both "Yes" and "No" selections 52*a*, 52*b* in the Confirm Alarm Status window 52, is logged and archived (40*a* in FIG. 4) in the background by the rapid alert system program onto the application server hard drive or other permanent storage device, including: User, date, time and location from which the alert was activated, the alert level selected, the building(s) alerted, and any Alarm Details provided by the User. Once the User selects the "Yes" confirmation option 52*a* and clicks on that button to activate the alarm 45, the alarm is sounded in the selected location(s) within seconds.

The "Off" option 47 can be made subject to confirmation by a second, higher (or essentially equivalent) authority person before that action is initiated, as it turns off the alert alarms, essentially muting the system, but does not turn off the system itself.

5 Rapid Alert System Application Program Management. As seen in FIGS. 5-8, above the location and alert level trees is the menu bar 90 which allows the user to do tasks ranging from changing their password and logging out on the low end to adding/editing/deleting users and locations at the high end (administrator level). Each menu item typically has a series of drop down sub-menu items separated in the menu 90 categories of "User Admin", "Location Admin", "Logs/Reports", "System", and "Options", each giving the user access to perform the respective tasks as described above. As shown in FIG. 8B, the drop down sub-menus 96 under "User Admin" provide options for adding a user or managing users. Each of those options may include additional options, for example, under Managing Users, which can include Change Authorization, Delete User, and the like. As shown in FIGS. 6 and 8C, the drop down sub-menus 96 for "Location Admin" vary by level of authorization, there being more options for the Regional level User in FIG. 8C than for the Principal level User in FIG. 6.

The Resources link 94 shown as a menu bar item in FIGS. 6-8C links to or directly opens a resource information database structure that includes displayable images and text selected from at least one of: sites and facility maps; evacuation plans, routes and staging locations; locations of utilities, medical supplies and emergency supplies and rations; fire suppression or escape devices and supplies; facility supervisory, maintenance and response personnel contacts; and response tactical data. In addition, referring to FIGS. 8A-8C, note the dog-eared page icons 92 next to Clallam and Port Angeles. This icon indicates that text is associated with that item. Thus, when the User's cursor flies over Clallam, a text reference pops-up in the lower half of the page, or alternatively, the text icon can be clicked to go to a text page relating the vital information about the county school system. In still another alternative, an additional Map icon can be placed next to the school, city or county location name so that there is an associated map displayed or link to the map database readily available so that the User can navigate to the map page immediately.

Additionally, referring to FIGS. 4-8C, the alert alarms are programmed to sound only for a limited time, ranging from minutes to continuously until turned off or the status is changed. In some situations, it may be necessary to re-sound the alarm if its programmed sounding time has expired. Whereas the software permits configuring changing the level of alert, say from Lockdown to Evacuate, to automatically terminate the unique Lockdown alarm sound (e.g., a repeated harsh note) and replace it with the different sound for Evacuate (e.g., two high pitched warbling notes), once the alarm sound period (on the order of 10-20 minutes or more) has terminated, the Lockdown alert button can be retriggered and the alarm will re-sound. This can be important when a danger situation occurs, for example at the beginning of the school day and students are arriving over an extended period of time. Some may not be present to hear the first alert alarm, so re-sounding it may be required. Alternately, the period the alert alarm sounds can be preprogrammed to be longer during certain times of the school day, for example at the beginning of the day. In another alternative, once a selected alert has been triggered, flying over it again with the cursor can cause a drop-down or pop-up option "Re-Sound Alarm?" can appear, permitting the User to select that option. Another alternative is to display an option for the User to select the time-period the alarm will sound. Additional alert alarm menu buttons such as those discussed above (Re-sound Alarm; Set Time for Alarm to Sound, etc.) can be added to the tree 43 on the right in FIGS. 5-8C.

With respect to color coding the alert hierarchy tree, the presently preferred color code is Red for Lockdown, Orange for Evacuate, Yellow or Gold for Shelter in Place, Blue for All Clear, Green for Off, and Test is Pale Blue. Note Test system 61 is reserved for the highest, Regional or above, User authorization level. As noted above, when the initial view of the school and building screen is displayed, FIG. 5, where the present status is all clear, the School 48, the Building 1 and Gym menu option boxes 44*b*, 44*c* and the Status report 46 at the bottom of the page show in green. Once an alert has been selected, Lockdown 56 for the School 48 as shown in FIG. 6, the color surround for the School and both Building 1 and the Gym, and the Status bar 46 in the lower half of the page changes to that alert menu color, here Red.

6. Event Over or Alert Off: Referring to the lower right corner of FIG. 4, once the event is over, or the status changes, or an alarm has erroneously been triggered, the User can access the inventive system as described above, and step through the screens to select the new alert and building from the alarm location 44 and alert type 43 hierarchical trees. In the presently preferred configuration of the inventive system, there is auto-override of a selected initial alert by a second alert that is subsequently selected and triggered. This is "on the fly" alarm sound shift. Alternately, the initial alert alarm is turned off by clicking on "Off" button 47, before the new alert level (54-60) is triggered by clicking on the new alert level icon in the alert tree 43 on the right side of those figures. In the case of "All Clear", 60, the sound may be a pleasant chime, accompanied by a voice announcement that the emergency event is over. The system is sufficiently flexible that different schools, including within a given system, may choose different alarm sounds and announcements. Thus, for an elementary school, the sounds and announcements can be tailored to be directive and assuring rather than frightening so that excess urgency does not trigger panic in the children.

The inventive rapid alert system employs a highly secure operating system on the application server 88, or individual work station 12, such as Linux (currently preferred) that provides a powerful yet flexible platform for running mission critical tasks, such as: serving web pages, providing database services, and securing networks by acting as an active firewall. One skilled in the art will recognize this list is not exhaustive of the functionality of a Linux operating system. In addition the applications software of the inventive rapid alert system may be constructed by use of a combination of Apache web server, MySQL database server, and PHP, Python, Java, XML, or other programming language, to thereby provide an OS-independent user interface that can be used by any computer either directly or with any of a number of conventional web browsers, such as Internet Explorer.

The inventive system at each network location (building) includes an application server (network control device) running, to not only sound the alert when triggered, but also act as a backup server for the entire system LAN/WAN network in case the master at the admin office should fail. Each server in the area system is identified within the system software by network IP address. All systems in the network continually synchronize themselves with the main server (network control device) so that in the event that the primary server goes down, the next subordinate server on the network picks up as the primary. This is enabled by giving each access point on the network a Computer Address Redundancy Protocol ID number to facilitate the synchronization and hand-off. In the event that the subordinate server goes down, the next one in line comes up, and so on. This level of redundancy is a vital part of the inventive system to address the need for a mission critical alert system. Any failure within the system causes an immediate sending of a message over the network to the system administrator or designee that a given server has failed, yet the next subordinate server takes over seamlessly.

Figure 9:
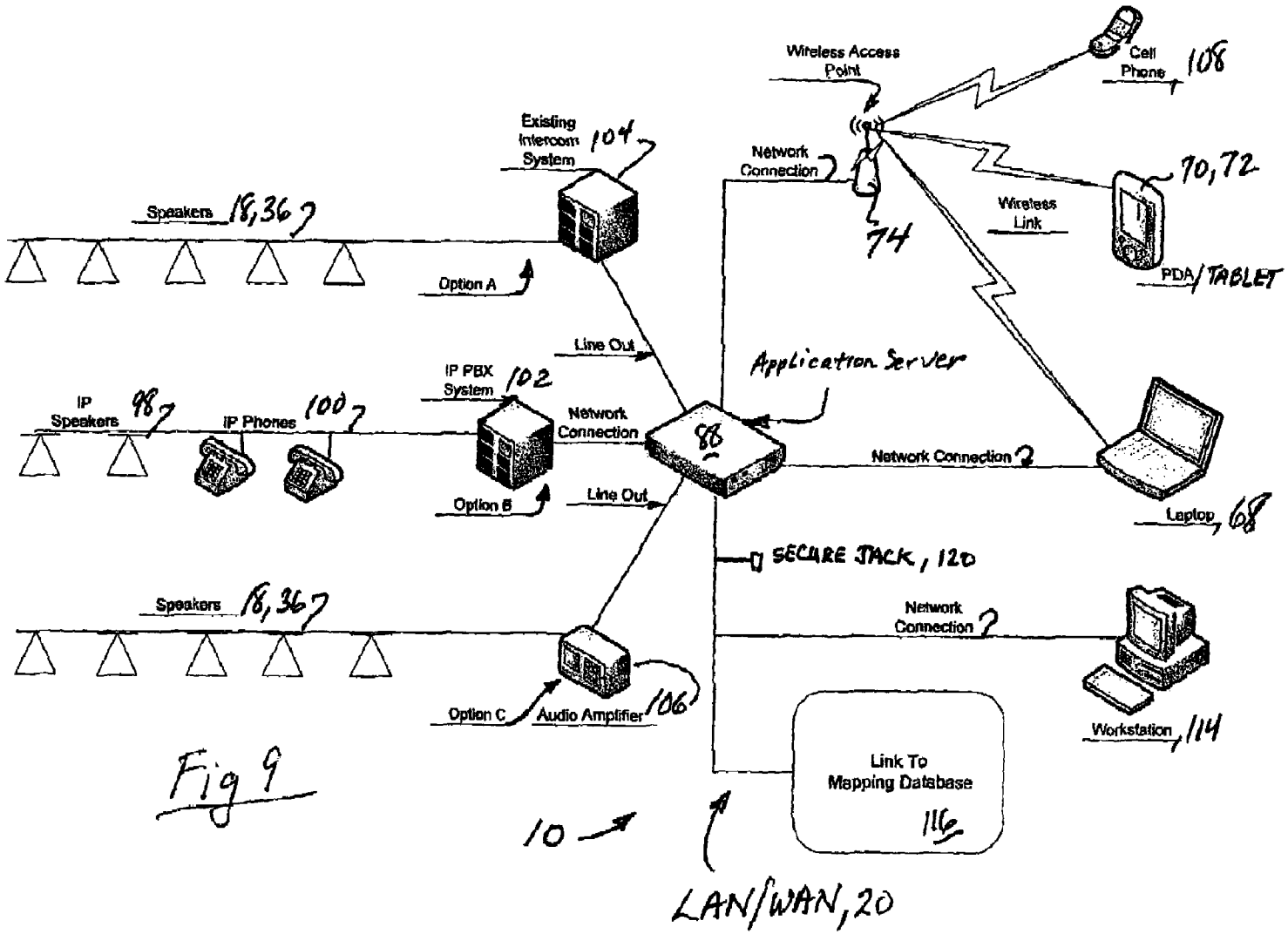
FIG. 9 is a schematic of the architecture of a presently preferred embodiment of the inventive rapid alert system, and showing three alternatives for speakers and IP telephones.

FIG. 9 shows a presently preferred embodiment of the inventive system 10 components in three options: Option A, employing speakers 18, 36 distributed throughout the facility in an existing intercom system 104: Option B, employing IP speakers 98 and phones (VOIP) 100 off an IP PBX system 102; and Option C, employing speakers 18, 36 off an audio amplifier 106. Each of these options are connected to an application server 88 which includes the above-described application control software for selecting and initiating the alert alarm in the selected facility by an authorized user having access via hard wired or wireless LAN/WAN network 20 from any one of a number of connectivity devices having display/command entry functionality and an appropriate user interface, such as cell phone 108, PDA 70 and/or tablet computer 72, Laptop 68, or workstation 114. In addition, the network is linked to a mapping database 116 for the facilities maps described above. The Network preferably includes a wireless access point, router or bridge 74 to permit wireless communication from/to the input devices 108-112. First (and later) Responders who have been given User Authorization can tap into the system to view status of affected buildings, including alert levels and maps for response tactical planning, via PDA, cell phone, laptop or desktop. Note that the wireless access device is bi-directional. That is, look-at and input to the system (facility/building selection and alert level triggering) can be done from the field by authorized personnel, and conversely, the system can send out an alert to the cell phones, pagers, PDAs, tablet computers, laptops and desktops of appropriate school personnel. For example, a teacher or student can receive a silent alert alarm by his/her cell phone or pager, in vibrate mode, being triggered by the system alert selection.

In the preferred embodiment, the User computers are client computer systems linked to said network and each includes a CPU, a data entry device, a display device, an operating program, and a client user interface for an authorized user to access the rapid alert application server via said network to interact with the inventive rapid alert application program to trigger user-selected ones of the alarms by data signals propagated on said network in response to user command inputs to the application program via the Users' client computer systems, the User commands including inputs: for selecting sites from among a plurality of occupant space sites in said facility; for selecting and confirming alert alarms from a plurality of types of alerts, including at least two of: lockdown; evacuate, shelter in place, all clear; and for selecting termination of an alarm from an alarm-off button. The application server comprises a computer having a CPU including integrated audio and video rendering capability or separate audio and video cards, an active (RAM) memory device, a data storage device such as a hard drive or other permanent data storage device, the rapid alert application program and an audio file structure on the data storage device (for the various alarm sounds and messages broadcast), and a network interface device. The application server is also configured to effect the redundancy hand-off in the event of unit failure, or optionally, a back-up hard drive or other permanent memory in suitable RAID array configuration may be used to assure system redundancy in the event of failure of one or more of the application servers in the system, typically one in each building of a facility.

Optionally, a jack in an external secure, hidden enclosure accessible to the response tactical unit can be provided so that upon arrival at the scene, the response unit (e.g., SWAT team) can tap into the system to obtain a view of the event through system status checking, maps, and real time video and audio feeds for data to make appropriate tactical response decisions.

Figure 10:
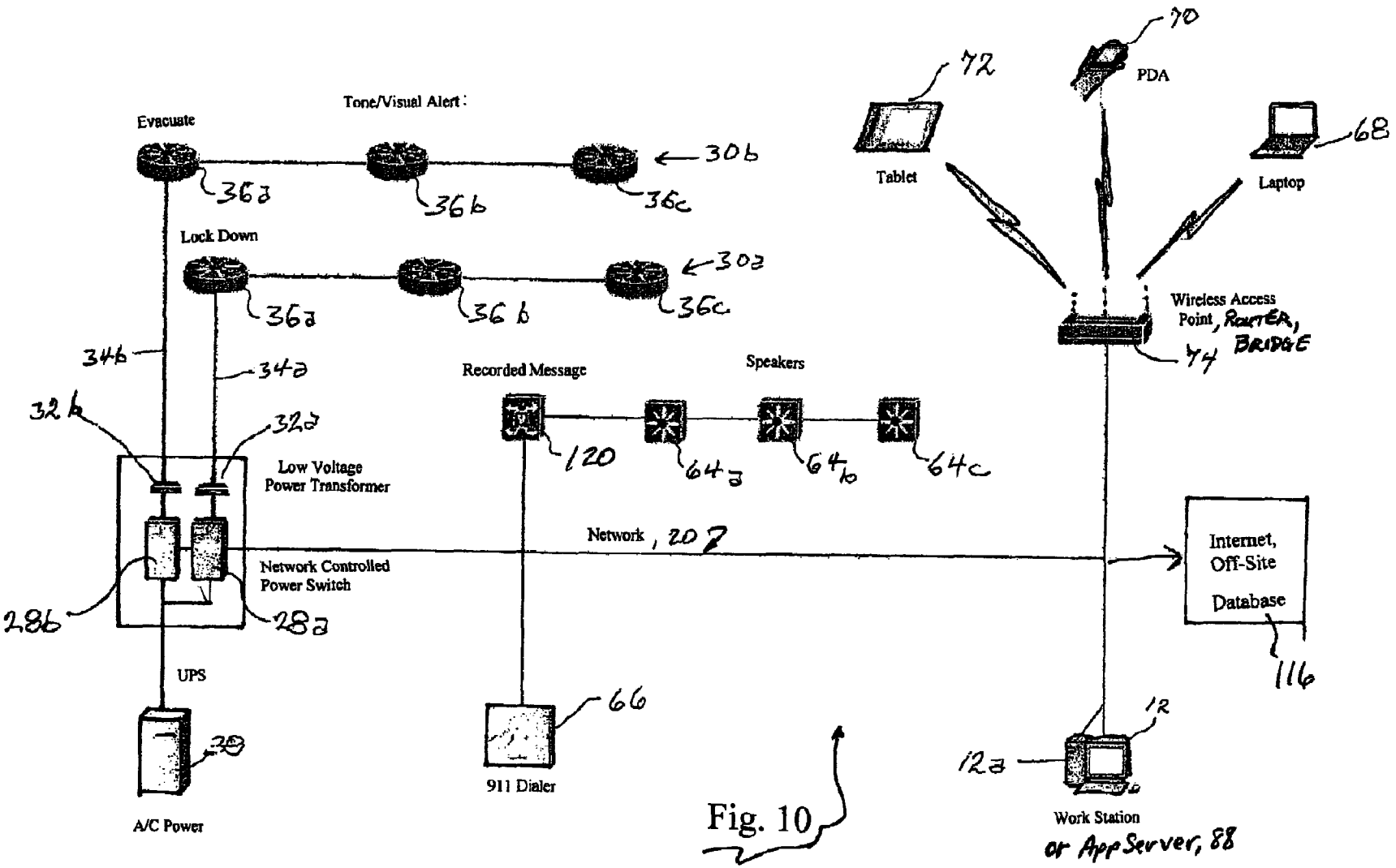
FIG. 10 is a schematic of a fifth embodiment of the inventive system that includes both hard-wired connections and wireless access, where a work station may also function as the inventive application server, and which provides for loudspeakers at alarm location within a facility or site, recorded message capability, and a 911 dialer that can be included in the embodiments as shown in FIGS. 1 to 4, and with a connection via the Internet to offsite databases or emergency response personnel.

FIG. 10 shows an embodiment of the inventive system illustrating the flexibility of the LAN system base. The FIG. 10 embodiment has the same alarm configuration as is shown in FIG. 3, using a universal power supply 38, network controlled power switches 28*a*, 28*b*, transformers 32, and alarms 36. A network-controlled pre-recorded voice message device 120 is included in the network to trigger a particular message as an announcement over loudspeakers 64. Wireless connection is enabled through wireless access point 74 for all connectivity devices not hardwired into the LAN/WAN, for example, a laptop computer 68, a PDA 70, and a tablet computer 72. One or more databases 116 are accessible to the system either through LAN/WAN or via Internet browser access. Alternatively, such databases are resident in the system and accessible by user interface. This figure also shows an example of the direct implementation where the work station 12 can be loaded with the inventive software for control of an alarm device in a selected space or location in accordance with the method of the invention.

Figure 11:
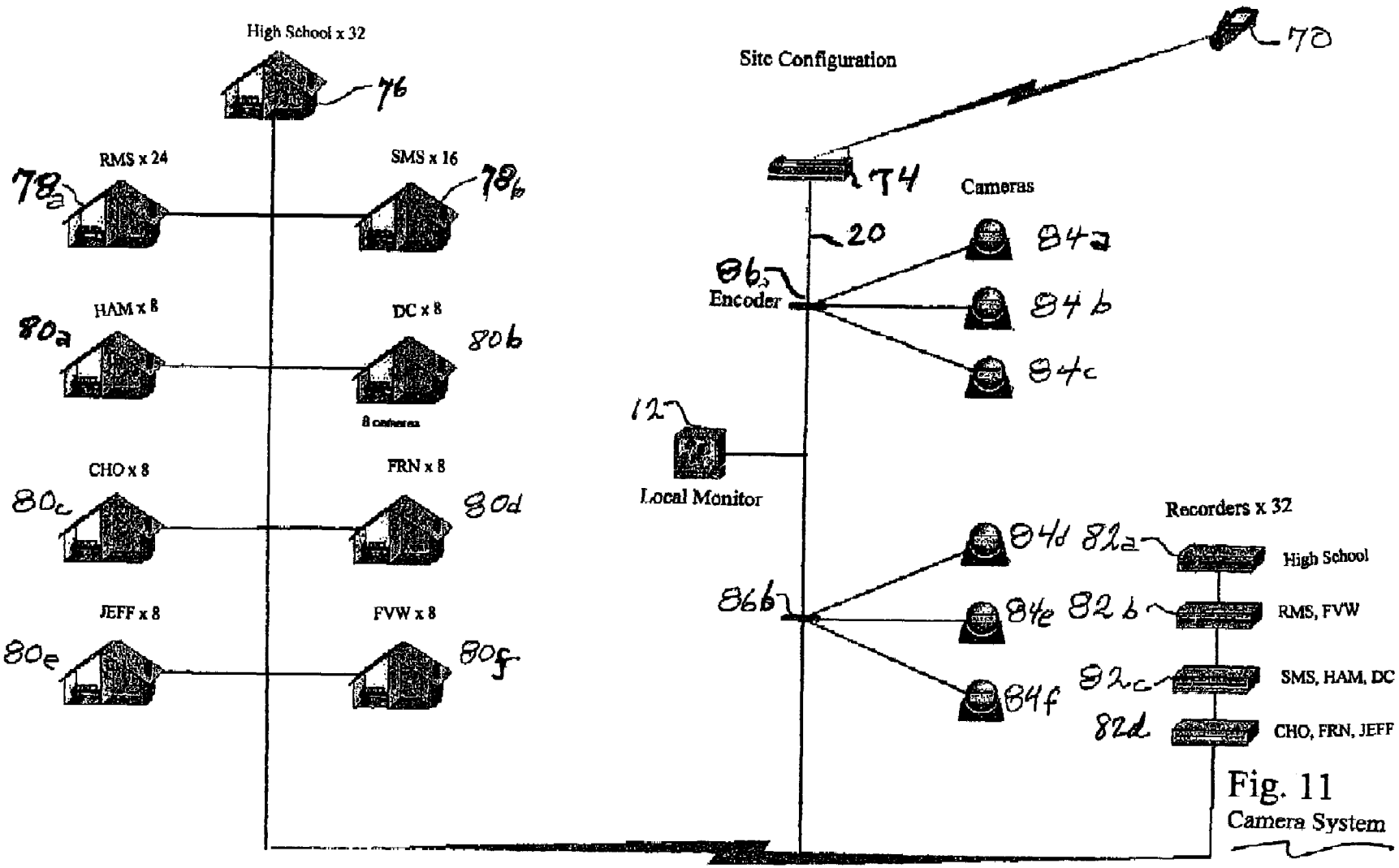
FIG. 11 is a schematic of an embodiment of the inventive system having IP camera capability and provision for recording of video data that is wirelessly linked.
Figure 12:
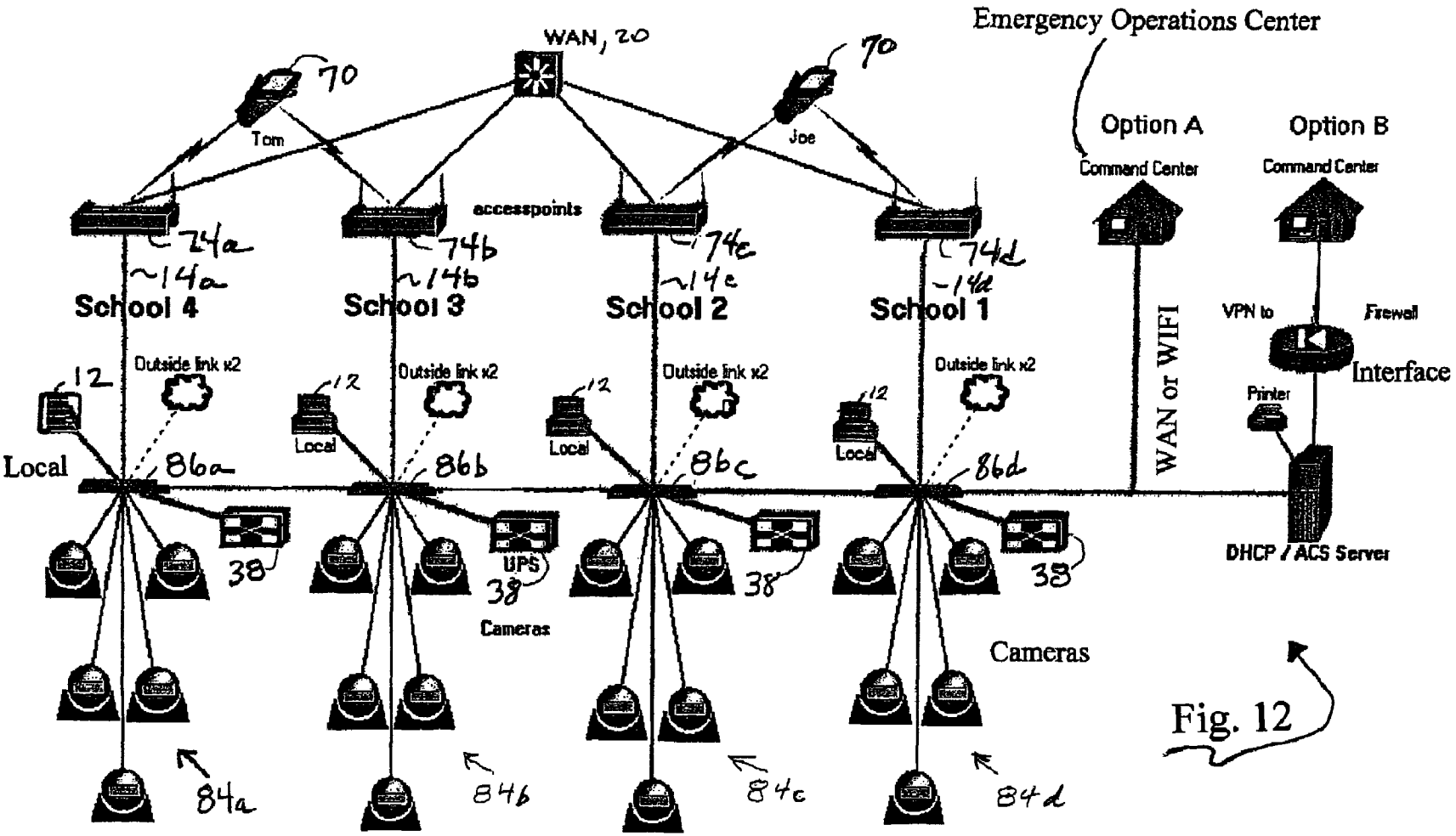
FIG. 12 shows an embodiment of the inventive system installed throughout a school district with a plurality of schools in a Wide Area Network to one or more rapid response Command Centers.

FIGS. 11 and 12 are related, with FIG. 11 showing the inventive system applied to a multi-school school district having including camera capability for real time and archival recording via LAN 20, and FIG. 12 showing the connectivity plan thereof. The exemplary city School District comprises a high school 76 having 32 cameras in place, two middle schools 78*a* and 78*b*, having 24 and 16 cameras in place, respectively, and six elementary schools 80*a*-80*f*, each having eight cameras in place. This camera embodiment uses a wireless access port 74 to provide real time camera views to law enforcement personnel, for example, using wireless hand held devices, such as PDA 70. The Wide Area Network 20 is shown in FIG. 12 as connected to the access ports 74*a*-74*d* (e.g., wireless routers) to integrate with the LAN systems of the individual Schools 1-4. Camera output is also available to the LAN/WAN computers 12 that are a part of the permanently installed system. Each group of cameras 84*a*-84*f* is connected to the network through camera encoders 86*a*-86*d*. A battery of four video recorders 82*a*, 82*b*, 82*c*, and 82*d* are installed at a central point of the network, for example at the central core. Each recorder is capable of accommodating 32 cameras and preserves recordings for about two weeks before over-recording, unless transferred to more permanent archival storage.

In accessing databases that are part of or linked to the inventive system, a full menu of options for searching and selecting specific information is included. The menu bar can include, for example, the following (each column to the right being a drop-down sub-menu):

| | | | |
|---|---|---|---|
| Alarms | History | | |
| | By School | County | |
| | | City | |
| | | Named School 1 | |
| | | Named School 2 | |
| Haz Mat | Regulations | | |
| | Events | | |
| Contacts | Administration | | |
| | Staff | | |
| | Response Personnel | Police | |
| | | Fire | |
| | | Medical | |
| | | Other | |
| Pre-Plan | Event Action | Fire | |
| | | Tornado | |
| | | Weapon | |
| Maps (Sites) | Region | | |
| | County | | |
| | City | School District | Admin |
| | | | High School |
| | | | Middle School 1 |
| | | | Middle School 2 |
| | | | Elementary 1 |
| | Security | | |
| | Evacuation routes | | |
| | Hydrants | | |
| | Staging Locations | | |
| | Utilities | | |
| | Tactical Plans | | |

For example, the maps of the facilities accessible via the inventive system include locations of fire hydrants, locations of hazardous materials storage points, action plans for various scenarios, reference information for contact with various authorities, connection to regional networks, and access to the alarm screens.

In accord with the present invention, an exemplary facility can be accessed by emergency response personnel as they are en route (via WiFi link to a Command Center), or at the site upon arrival (via a plug-in link to the inventive system, or by WiFi to a laptop, mini computer or hand-held PDA), or at the local facility or site admin office, so that they can ascertain the location of the emergency in the complex and make necessary tactical plans for response on the ground in real time. In this regard, the IR and US sensors, and other presence or locator sensors or systems (video, audio, pressure transducers, GPS, proximity sensors and the like) can be linked to the system to identify and/or locate the presence of every person in the affected area, and their movements monitored in real time during the event by viewing on the system screens from remote locations.

INDUSTRIAL APPLICABILITY

The inventive system is effective, economical and designed for any number of emergency situations, such as active shooter(s) on campus, flood, fire, hazardous material spill or release, earthquake, tornado, hurricane, tsunami, terrorist or gang attack, or military or para-military event. Audio broadcasts and alert options are easily customized to accommodate any type of event or pre-existing emergency protocol.

The inventive rapid alert system has applicability to a wide range of facilities in or at which the public congregates, including schools, theatres, malls, hotels, government buildings, courts, and the like. The system has straight-forward configurability and a wide range of adaptability to facilities having diverse physical architecture and layout. It is unlimited as to the types of alerts that can be programmed and configured into the applications software that causes the computer to control the system and includes functionality to immediately change the type or status of alert in any given building or facility. Accessibility to the system by outside responders to detailed information, such as site maps, floor plans, and real-time camera views of interiors enables a new range of response capability, as well as the ability to safely evacuate one building at a time within the alarmed complex by simply changing the alert type, e.g., from lockdown to evacuate, in a serial, timed manner to permit orderly evacuation without creating a crowd situation that engenders panic. The inventive system permits managers to quickly provide warning to their entire networked district to a pending threat by simply selecting the appropriate alert and building(s) or entire school system, to take the appropriate action. Thus, the inventive system has the clear potential of becoming adopted as the new standard for public facilities.

It should be understood that various modifications within the scope of this invention can be made by one of ordinary skill in the art without departing from the spirit thereof and without undue experimentation. For example, the system control and operational programs can have a wide range of designs to provide the functionalities disclosed herein. Thus, keeping within the spirit of the invention, it is straight-forward to provide the inventive application program as a stand alone program or embedded as part of an Operating System-type program, such as one of the Windows programs of Microsoft, OS-X of Apple, Linux or the like. As used herein the term "browser" is equivalent to the term "user interface". This invention is therefore to be defined by the scope of the appended claims as broadly as the prior art will permit, and in view of the specification if need be, including a full range of current and future equivalents.

PARTS LIST To assist examination; may be canceled upon allowance at option of Examiner.

| | |
|---|---|
| 10 | Inventive Rapid Alert System |
| 12 | Control computer or workstation |
| 14 | LAN/WAN cable, CAT 5 or similar |
| 16 | Powered Network Switch |
| 18 | Multi-tone alarm Unit with multi-colored strobe light |
| 20 | LAN |
| 22 | Power Injector |
| 24 | Series of multi-tone/strobe Alarms |
| 26 | phone line (POTS line) |
| 28a, b | Modem-controlled power switch |
| 30 | Series of multi-tone alarms |
| 32 | Low voltage power transformer |
| 34 | Standard wiring lines |
| 36 | multi-tone alarms, no strobes |
| 38 | Uninterrupted power source |
| 39 | Admin Windows |
| 40 | Start browser; 40 a Archive User activities |
| 41 | Connect to Web Server; 41a Display Logon Page |
| 42 | Validate Name/Password; 42a Authorization Level Check |
| 43 | Select alarm type from menu |
| 44 | Select Buildings (44a Entire School, 44b Specific Building) |
| 45 | Activate selected alarm |
| 46 | Status Window |
| 47 | Deactivate selected alarm (off) |
| 48 | Select Region (48a County, 48b City) |
| 50 | Confirm Alarm Status |
| 52 | Confirmation Choice (a. yes, b. no) |
| 53 | Alarm Details |
| 54 | Evacuate buildings |
| 56 | Lock-down buildings |
| 58 | Shelter-in-place |
| 60 | All clear |
| 61 | Test |
| 62 | Message recorder |
| 64 | Loudspeaker/WAN to the alarm units |

-continued

PARTS LIST To assist examination; may be canceled upon allowance at option of Examiner.

| | |
|---|---|
| 66 | 911 dialer |
| 68 | Laptop computer |
| 70 | FDA |
| 72 | Tablet computer |
| 74 | Wireless access point |
| 76 | High School |
| 78 | Middle school |
| 80 | Elementary school |
| 82 | Video recorder |
| 84 | Network camera |
| 86 | Camera encoder |
| 88 | Application Server |
| 90 | Menu Bar |
| 92 | Text and/or maps icon |
| 94 | Maps DB Link |
| 96 | Dropdown options |
| 98 | IP Speakers |
| 100 | IP Phones |
| 102 | IP PBX System |
| 104 | Existing Intercom System |
| 106 | Audio Amplifier |
| 108 | Cell Phone |
| 110 | |
| 112 | |
| 114 | Work Station |
| 116 | Mapping Database |
| 118 | Recorded Message Unit |

The invention claimed is:

1. A computer-enabled rapid alert propagation and management system for initiating audio and/or visual alarms relating to emergency events that can threaten the safety of occupants in places of public, private and governmental facilities comprising in operative combination:

a) a secure network between a central administrative office of a public, private or governmental facility and a plurality of remote, related occupant space sites associated with said facility;

b) a plurality of multi-tone audio alarms disposed associated with at least some of said occupant space sites connected to said network, said alarms being selected from tone alarms and voice message delivery devices;

c) at least one computer including functionality of an application server for providing an alarm data signal to said network, said application server including a rapid alert initiation, management and archiving application program as an individual application or as part of an Operating System program suite;

d) at least one connectivity device functioning as a client computer linked to said network including a CPU, a data entry device, a display device, an operating program, and a client user interface for an authorized user to access said application server via said network to interact with said rapid alert application program to trigger user-selected ones of said alarms propagated on said network in response to user command inputs to said application program via said client computer, said user commands including inputs: for selecting sites from among a plurality of occupant space sites in said facility; for selecting and confirming alert alarms from a plurality of types of alerts, including at least two of: lockdown; evacuate, shelter in place, all clear; and for selecting termination of an alarm from an alarm- off button; and e) whereby said system provides authorized user-configured and selected rapid alerts to user-selected occupants or sites of said facility of impending or in-progress dangerous or threatening events from anywhere on the network in one or more of levels of directed action to be taken by occupants, and permitting viewing of the status of the alerts by responding personnel during the course of the event, and archiving data about the event including user-initiator of the alert, level of the alert, date and time of alert activation, and change in alert status to an all clear status at the termination of the event.

2. A rapid alert system as in claim 1 wherein said application server comprises a computer having a CPU including integrated audio and video rendering capability, an active memory device, a data storage device, said rapid alert application program and an audio file structure on said data storage device, and a network interface device.

3. A rapid alert system as in claim 2 wherein said network includes a wireless access device for access to the network to initiate and view alerts and alert alarm status and to permit transmission of alerts to wireless devices having access to the network.

4. A rapid alert system as in claim 3 wherein said system hardware architecture includes connection to alarm devices in at least one of: a) existing intercom system; b) IP PBX, said alarm devices s including at least one of IP speakers and IP phones; and c) and audio amplifier.

5. A rapid alert system as in claim 4 wherein said connectivity device is selected from at least one of a cell phone, a PDA, a tablet computer, a laptop, and a desktop computer.

6. A rapid alert system as in claim 3 wherein said rapid alert application program is accessible by authorized responders to view alert and alarm status of said selected occupant spaces of said facility for tactical planning of response to said emergency condition.

7. A rapid alert system as in claim 3 wherein said system communicates alert signals to at least one of a cell phone and a pager of facility personnel.

8. A rapid alert system as in claim 2 wherein said multi-tone alarm devices have strobe-type lights.

9. A rapid alert system as in claim 2 wherein said rapid alert application program includes a link to a resource information database structure that includes displayable images and text selected from at least one of: sites and facility maps; evacuation plans, routes and staging locations; locations of utilities, medical supplies and emergency supplies and rations; fire suppression or escape devices and supplies; facility supervisory, maintenance and response personnel contacts; and response tactical data.

10. A rapid alert system as in claim 9 wherein said database structure is resident in at least one of said applications server or on a memory device connected to said network and accessible by said rapid alert applications program via said user interface.

11. Method of rapidly initiating and propagating alerts relating to emergency events that can threaten the safety of occupants in places of public, private and governmental facilities by triggering audio and/or visual alarms comprising the steps of:

a) providing a secure network between a central administrative office of a public, private or governmental facility and a plurality of remote, related occupant space sites associated with said facility;

b) connecting a plurality of multi-tone audio alarms disposed associated with at least some of said occupant space sites to said network, said alarms being selected from tone alarms and voice message delivery device;

c) connecting at least one connectivity device provided with functionality of an application server for providing an alarm data signal to said network, said application server including a rapid alert initiation, management and archiving application program as a stand-alone program or as embedded in an Operating System suite;

d) linking at least one client connectivity device acting as a computer to said network, said client connectivity device including a CPU, a data entry device, a display device, an operating program, and a client user interface for an authorized user to access said application server via said network to interact with said rapid alert application program to trigger user-selected ones of said alarms propagated on said network in response to user command inputs to said application program via said client connectivity device, said user commands including inputs: for selecting sites from among a plurality of occupant space sites in said facility; for selecting and confirming alert alarms from a plurality of types of alerts, including: evacuate, shelter in place, all clear; and for selecting termination of an alarm from an alarm-off button;

e) configuring said rapid alert applications program to command said server to provide authorized user-selected rapid alerts to user-selected occupants or sites of said facility of impending or in-progress dangerous or threatening events from anywhere on the network in one or more of levels of directed action to be taken by occupants;

f) permitting viewing of the status of the alerts by responding personnel during the course of the event; and g) archiving data about the event including user-initiator of the alert, level of the alert, date and time of alert activation, and change in alert status to an all clear status at the termination of the event.

12. Method of initiating and propagating rapid alerts as in claim 11 which includes the steps by a user, in order to initiate an alert alarm, of:

a) logging in to the rapid alert applications program and providing a unique password;

b) selecting a facility site;

c) selecting an alert type or level; and d) confirming the alert type or level and site location.

13. Method of initiating and propagating rapid alerts as in claim 12 which includes the added step by an authorized user of at least one of entering remarks about the nature of the event during the confirmation step and providing prerecorded message to be broadcast in association with a selected alert alarm type.

14. Method of initiating and propagating rapid alerts as in claim 13 which includes the added step by an authorized user or responder of accessing a database of resource information selected from displayable images and text selected from at least one of: sites and facility maps; evacuation plans, routes and staging locations; locations of utilities, medical supplies and emergency supplies and rations; fire suppression or escape devices and supplies; facility supervisory, maintenance and response personnel contacts; and response tactical data.

15. Method of initiating and propagating rapid alerts as in claim 11 which includes the added step of printing archived data relating to events of authorized user access to said rapid alert applications program and actions taken by said user.

16. Method of initiating and propagating rapid alerts as in claim 11 which includes the added step of said authorized user changing the alert level or type, or turning an alarm off, during the progress of the initial alert event to thereby change the alarm sounded.

17. Method of initiating and propagating rapid alerts as in claim 11 which includes the added step of said authorized user managing said rapid alert application program configuration through at least one of modifying, updating or adding: user(s), facilities data, alert messages and level(s); resources database; and changing passwords.

18. Rapid alert applications program resident as a stand-alone program or a code portion of an Operating System suite, installed in at least one connectivity device configured to function as an application server alone or as a part of a network for causing multi-tone alarms selected from tone alarms and voice message alarms connected in said network and distributed in association with occupant spaces in a public, private or governmental facility to sound alarm signals of an imminent or in-progress event that threatens the safety of occupants in said spaces upon alert by an authorized user accessing said program from any client connectivity device linked to said network comprising the functionality of:

a) user interface accessibility;

b) user authorization verification;

c) hierarchical tree categories of facilities included in said network, related groups of spaces of each said facility being selectable, and selecting a broader category including all spaces included in said category;

d) a menu permitting selection of at least one from among:

i) alert types including at least two of: lockdown; evacuate; shelter in place; all clear; and for an alarm-off button;

ii) alert natures selected from tone alarms and voice message alarms; and iii) location of where alert is to be distributed;

e) confirmation of alert type, alert nature and location selection;

f) entry of comments on the nature of, or additional instructions relating to response to, the emergency;

g) access to a resources information database; and h) menu of configuration and management of the system users and data in wizard template format.

19. Rapid alert applications program as in claim 18 which includes a functionality of displaying said database of resource information selected from displayable images and text selected from at least one of: sites and facility maps; evacuation plans, routes and staging locations; locations of utilities, medical supplies and emergency supplies and rations; fire suppression or escape devices and supplies; facility supervisory, maintenance and response personnel contacts; and response tactical data.

20. Rapid alert applications program as in claim 18 which includes functionalities of archiving all user activity in the program, and printing reports of said user activity.

* * * * *